United States Patent [19]

Ikenoue et al.

[11] 4,207,112

[45] Jun. 10, 1980

[54] HEAT DEVELOPABLE LIGHT-SENSITIVE MATERIALS

[75] Inventors: Shinpei Ikenoue; Takao Masuda; Shinichi Sakawaki, all of Asaka, Japan

[73] Assignee: Fuji Photo Film Co., Ltd., Minami-ashigara, Japan

[21] Appl. No.: 628,675

[22] Filed: Nov. 3, 1975

[30] Foreign Application Priority Data

Nov. 1, 1974 [JP] Japan ..... 49-12671

[51] Int. Cl.[2] ..... G03C 1/02; G03C 5/24; G03C 1/48; G03C 1/87

[52] U.S. Cl. ..... 430/566; 430/617

[58] Field of Search ..... 96/114.1, 110, 108, 96/48 HD, 48 PD, 87 R, 76 R, 73

[56] References Cited

U.S. PATENT DOCUMENTS

| | | | |
|---|---|---|---|
| 2,892,712 | 6/1959 | Plambeck | 96/35 |
| 3,144,331 | 8/1964 | Thommes | 96/27 |
| 3,220,841 | 11/1965 | Stevens | 96/78 |
| 3,240,604 | 3/1966 | Cook | 96/73 |
| 3,598,587 | 8/1971 | Yudelson | 96/48 |
| 3,708,304 | 1/1973 | Hiller | 96/114.1 |
| 3,751,252 | 8/1973 | Smith et al. | 96/114.1 |
| 3,761,273 | 9/1973 | Miller | 96/114.1 |
| 3,767,448 | 10/1973 | Hutton | 96/87 R |
| 3,846,136 | 11/1974 | Sullivan | 96/114.1 |
| 3,885,969 | 5/1975 | Kruck | 96/87 R |
| 3,997,346 | 12/1976 | Masuda et al. | 96/114.1 |

*Primary Examiner*—Travis Brown
*Assistant Examiner*—L. Falasco
*Attorney, Agent, or Firm*—Sughrue, Rothwell, Mion, Zinn and Macpeak

[57] ABSTRACT

A heat developable light-sensitive material comprising a support carrying at least one layer containing at least (a) an organic silver salt, (b) a light-sensitive halide or a light-sensitive silver halide-forming component, (c) a reducing agent and (d) phthalazinone, and which further has on another surface of the support opposite the above layer one layer containing a compound comprising a

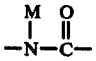

moiety, wherein M represents a hydrogen atom or a monovalent metal atom. The material shows improved retention of its as manufactured properties, especially in the superposed state.

10 Claims, No Drawings

HEAT DEVELOPABLE LIGHT-SENSITIVE MATERIALS

BACKGROUND OF THE INVENTION

1. Field of the Invention

This invention relates to a heat developable light-sensitive material and particularly to a heat developable light-sensitive material having on the back surface of the support thereof one layer containing a compound with a

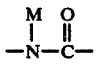

unit to improve the retention of the freshly manufactured properties of the light-sensitive material (hereafter the freshness retention capability), especially in those situations where the materials are stacked in a superposed condition upon other such materials.

Freshness-retention capability means the capability of light-sensitive materials to retain their fresh photographic characteristics during storage extended periods. This is an extremely important commercial property, as the photographic characteristics of light-sensitive materials poor in freshness-retention capability change from the time of manufacture until they come into consumers' hands, which lowers the commercial value thereof. Moreover, it is undesirable for consumers that the characteristics of light-sensitive materials at the completion of their use are different from their characteristics at the beginning of use.

2. Description of the Prior Art

Silver halide-using photography has been much more universally carried out, as compared to electron photography, diazo photography and the like, as the former offers excellent photographic characteristics such as sensitivity, gradation, etc., as compared to the latter. However, silver halide photography requires extensive time and labor as silver halide light-sensitive materials must be development-processed with a developing solution after image-wise exposure, and then subjected to several treatments such as stopping, fixing, washing, stabilizing and other similar processings, using solutions to prevent a developed image from changing color or deteriorating under indoor light, or in order to protect undeveloped white areas (called background) from blackening. In addition, there and other troubles with the use of conventional silver halide materials such as danger to humans due to the chemical agents used in the above method, e.g., processing areas and workers' hands and clothes are often contaminated with the reagents used. Further, pollution is often caused by discarding the solutions used in the above-mentioned treatments into rivers.

Therefore, it has been strongly desired to provide highly sensitive silver halide photographic materials which can be dry processed instead of processed in solutions, so as to provide stable developed images and to reduce background color changes under exposure to indoor light.

Much effort has been expended the art to solve these problems. For example, the incorporation of a 3-pyrazolidone developing agent into a silver halide emulsion made it possible to develop light-sensitive materials by the application of heat, as disclosed in German OLS Nos. 1,123,203, 1,174,157 and so on. In addition, developing speed was accelerated by adding a water-donating substance to the above-mentioned developing agent when the above-mentioned emulsion system is heated, as disclosed in German OLS No. 1,175,075. Moreover, the addition of a fixing agent for silver halide to the above-mentioned developing agent is described in German OLS No. 1,003,578. However, these techniques do not completely stabilize the silver halide particles which remain in the dry processed light-sensitive material to light, i.e., dry fixing is not described in the first three patents above and, as one would expect, the presence of a developing agent (reducing agent) and a fixing agent as described in the last patent above causes undesirable reactions on storage, and renders the last method above impractical for commercial use.

In the art of light-sensitive materials which can provide photographic images by receiving photographic treatments in the dry condition, the most successful ones are, at present, the heat developable light-sensitive materials which are disclosed in U.S. Pat. Nos. 3,152,904 and 3,457,075, wherein the compositions contain as essential components silver salts of organic acids, a small amount of silver halide and a reducing agent. In such a light-sensitive system, silver halide particles remain in the light-sensitive material after developing without stabilizing. Nevertheless, such light-sensitive systems provide satisfactory results, as do light-sensitive materials which contain residual silver halide which has been stabilized to light. This is because the slight coloration resulting from the decomposition of such a small amount of residual silver halide caused by light-exposure can barely be perceived by human eyes since only a small amount of silver halide is used, and a large portion of the silver component exists in the form of white or pale yellow organic silver salts which are so stable to light that they hardly blacken upon light-exposure. Such light-sensitive systems an stable at ordinary temperatures, but when heated, usually up to 80° C., preferably 100° C., after image-wise exposure, they form an images because an oxidizing agent (organic silver salt) and a reducing agent present in a light-sensitive layer thereof undergo a redox reaction in the presence of a catalytic amount of exposed silver halide in the vicinity thereof to liberate silver which quickly blackens exposed areas of the light-sensitive layer and causes contrast between exposed areas and unexposed areas (background).

The present invention relates to an improvement on the above-described heat developable light-sensitive materials.

As described, the three essential components of such heat developable light-sensitive materials are an organic silver salt, a small amount of silver halide and a reducing agent. Usually, the light-sensitive materials containing these three components only provide yellow or pale yellow images when heat-developed after the image-wise exposure. Therefore, color toning agents are necessary so that dark tone images, i.e., black, brownish black, greenish black or violet-black images, can be obtained. Thus far, a wide variety of compounds are known as such color toning agents.

The effectiveness of a color toning agent is influenced by the organic silver salt and the reducing agent used in combination therewith. Most commonly used color toning agents include heterocyclic organic compounds which contain at least two hetero atoms, and which contain at least one nitrogen atom in the heterocyclic ring thereof, as disclosed in U.S. Pat. No. 3,080,254. Specific examples thereof include phthalazone (phthalazinone), phthalic anhydride, 2-acetylphthalazinone, 2-phthalylphthalizinone, substituted phthalazinones as disclosed in U.S. Pat. No. 4,076,534, pyrazoline-5-ones as disclosed in Japanese Patent Laid-Open No. 6077/71; cyclic imides such as phthalimide, N-hydroxyphthalimide, N-potassium phthalimide, phthalimide silver, etc.; quinazolines; phthalazinone silver; mercapto compounds as disclosed in Japanese Patents (Laid-Open) 5019/74 and 5020/74; oxazinediones as disclosed in U.S. Pat. No. 3,885,967; phthalazinediones as disclosed in U.S. Pat. No. 4,076,534; uracyls as disclosed in Japanese Patent Application No. 18378/74; N-hydroxy-naphthalimides as disclosed in U.S. Pat. No. 3,782,941; substituted phthalimides as disclosed in German OLS Nos. 2,140,406, 2,141,063 and 2,220,597, and phthalazinone derivatives as disclosed in German OLS No. 2,220,618.

However, only phthalazinone is accepted as an excellent color toning agent which enables the formation of black tone images, and which does not impair desireable photographic properties, e.g., anti-thermal fogging capability, light-stability, sensitivity, density and the like. Of course, the combined use of phthalazinone and the above-mentioned other color toning agents can provide considerably good results. Phthalazinone is effective when used in concentrations ranging from about 0.01 mole to about 5 mole, preferably from about 0.1 mole to about 2 mole, per mole of organic silver salt.

However, phthalazinone-containing heat developable light-sensitive materials suffer one serious disadvantage: they are poor in freshness retention capability, that is, the photographic characteristics of such light-sensitive materials are not stable upon storage. Long-term storage of such light-sensitive materials under high temperature and high humidity remarkably lowers their density and sensitivity to result in the disappearance of images. It is thought that one of the reasons for the decrease in density and sensitivity is that phthalazinone in the light-sensitive material sublimes into the air on a storage.

More particulary, such a light-sensitive material shows poor preservability when the light-sensitive layer thereof is in contact with the back surface of a support (e.g., it is rolled, or it is cut into sheets which are piled up.). This is a serious disadvantage, for light-sensitive materials usually come into the consumers' hands in such a state that a light-sensitive layer is in contact with the back surface of a support.

Freshness-retention capability can be rapidly examined by the use of a forced deterioration test on the light-sensitive materials, where the light-sensitive materials are exposed to air at elevated temperatures. It has been found that a forced deterioration test at 50° C. for 24 hours corresponds approximately to the deterioration over three months at room temperature (20° C.). Therefore, the freshness-retention capability at room temperature can be predicted from this forced deterioration test.

The solution of the above-mentioned problems has been an important goal in this art.

SUMMARY OF THE INVENTION

It is, therefore, one object of the present invention to provide a heat developable light-sensitive materials of excellent freshness-retention capability.

Another object of the present invention is to provide a heat developable light-sensitive material which can form a black tone image.

A further object of the present invention is to provide a heat developable light-sensitive material which forms a black tone image and which has excellent freshness-retention capability.

These and other objects of the present invention will become clearer from the following description.

The present invention which realizes the above-described objects if characterized by a heat developable light-sensitive material which comprises a support carrying at least one layer containing at least (a) an organic silver salt, (b) a light-sensitive silver halide or a light-sensitive silver halide-forming component, (c) a reducing agent and (d) phthalazinone, and having on the surface of the support opposite to such layer one layer containing a compound containing at least a

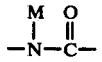

moiety, wherein M represents a hydrogen atom or a monovalent metal atom.

DETAILED DESCRIPTION OF THE INVENTION

Methods for applying the layer containing a compound having at least the

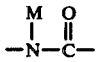

moiety to the back surface of a support, which is the characteristic feature of the present invention, will be described hereinafter. A coating solution prepared by the compound containing the

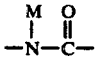

moiety being dissolved or dispersed into a high molecular weight binder is generally coated on the back surface of a support. Another method comprises adding the compound containing the

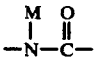

moiety to paper for the support when the support paper is made.

Moreover, the compound containing the

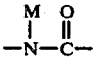

moiety can be sprayed onto the back surface of a support by an atomizer.

Also, the compound containing the

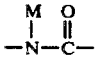

moiety can be transferred from another sheet containing the compound to the back surface of a support by superposing the sheet upon the back surface of the support sheet, and then applying pressure or heat to the superposed sheets; while less generally used than the first three methods given, such can be effectively used herein.

The compound having the

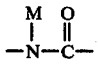

moiety should be coated on the back surface of a support in an amount ranging from about 0.01 to about 10 g, preferably from about 0.1 g to about 1 g, per square meter of the support. These ranges also apply when the compound is transferred to or impregnated in the support. The binders used in the present invention are conventional binders for heat-developable light-sensitive materials.

The high molecular weight material employed as a binder compound can be hydrophobic or hydrophilic. Examples of such binders include gelatin, proteins such as gelatin derivatives, cellulose derivatives, polysaccharides such as dextran, natural substances such as gum arabic, latex-like vinyl compounds which increase the dimensional stability of the photographic materials, and synthetic polymers as described in U.S. Pat. Nos. 3,142,586, 3,193,386, 3,062,674, 3,220,844, 3,287,289 and 3,411,911. Specific examples of effective polymers include water-insoluble polymers prepared from monomers such as alkyl acrylates, alkyl methacrylates, acrylic acid, sulfoalkyl acrylates, sulfoalkylmethacrylates, etc., cyclic sulfobetaine containing polymers as disclosed in Canadian Pat. No. 774,054 and the like. Preferred high molecular weight compounds and resins include gelatin, polyvinyl butyral, polyacryl amide, cellulose acetate butyrate, cellulose acetate propionate, polymethyl methacrylate, polyvinyl pyrrolidone, polystyrene, ethyl cellulose, polyvinyl chloride, chlorinated rubber, polyisobutylene, butadiene-styrene copolymers, vinyl chloride-vinyl acetate copolymers, vinyl acetate-vinyl chloride-maleic acid copolymers, polyvinyl alcohol, polyvinyl acetate, benzyl cellulose, cellulose acetate, cellulose propionate, cellulose acetate phthalate and so on, which be used as combinations thereof, if desired. The binder is most effectively used in an amount ranging from about 0.002 g to about 40 g, preferably from about 0.02 g to about 4 g, per square meter of a support.

When a paper support is used, a carrier such as kaolin, silica, starch, zinc oxide, titanium oxide, alumina, clay, etc., can be added to the back layer of the paper support to make it possible to make an entry in the back surface of the photographic material with a ball-point pen, a pencil or the like.

The improvement in the freshness-retention capability resulting from preventing phthalazinone from subliming into air, which is possible by coating a

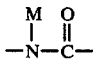

moiety containing compound on the back surface of the support according to one of the above-mentioned methods, can be attained even when photographic materials are stored in such a condition that a light-sensitive layer is in contact with the back surface of another support, which is a conventional stacking technique. It will be apparent from the later provided reference samples that images rapidly disappear upon storage if such a coated-back layer is absent.

Compounds containing a

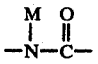

moiety (wherein M represents a hydrogen atom or a monovalent metal atom) which are most preferably used in the present invention include those which are represented by the following general formulae (I), (II) and (III):

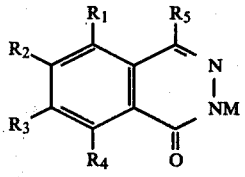

(I)

(wherein $R_1$, $R_2$, $R_3$ and $R_4$ each represents a hydrogen atom, a halogen atom, an alkyl group, an alkoxy group, a nitro group, an amino group or a hydroxy group, and $R_5$ represents a hydrogen atom, a halogen atom, an alkyl group (which term includes a substituted alkyl group), an alkoxy group, an aryl group (which term includes a substituted aryl group), a pyridyl group or a vinyl group (which term include a 2-substituted vinyl group). In the above-described general formula, preferable halogen atoms for $R_1$, $R_2$, $R_3$ and $R_4$ include chlorine and bromine atoms; preferred alkyl group therefor include alkyl groups having 1–4 carbon atoms such as methyl, ethyl, propyl, butyl, t-butyl, etc.; preferable alkoxy groups therefor include the alkoxy groups having 1–4 carbon atoms such as methoxy, ethoxy, propoxy, butoxy, etc.; preferred halogen atoms for $R_5$ include a chlorine atom, a bromine atom and the like; preferred alkyl groups for $R_5$ include alkyl groups having 1–4 carbon atoms such as methyl, ethyl, propyl, butyl, etc.; preferred alkoxy groups for $R_5$ include alkoxy groups having 1–4 carbon atoms such as methoxy, ethoxy, propoxy, butoxy, etc.; preferred aryl groups for $R_5$ include a phenyl group, a 1-naphthyl group, a 2-naphthyl group and the like; preferred substituted alkyl groups for $R_5$ include halogenoalkyl groups having 1–4 carbon atoms such as chloromethyl, bromoethyl, chloropropyl, chlorobutyl, etc., hydroxyalkyl groups having 1–4 carbon atoms such as a hydroxymethyl, $\beta$-hydroxyethyl, $\gamma$-hydroxypropyl, $\delta$-hydroxybutyl group, etc., aminoalkyl groups having 1–4 carbon atoms such as aminomethyl, aminoethyl, aminobutyl, etc., $C_1$–$C_4$ alkyl groups having amino groups substituted with a $C_1$–$C_4$ alkyl group such as dimethylaminomethyl, dimethylaminoethyl, etc., aralkyl groups such as benzyl, phenethyl, etc., alkoxyaralkyl groups such as p-methoxybenzyl, etc., and morpholino-substituted $C_1$–$C_4$ alkyl groups such as a morpholinomethyl, morpholinoethyl, morpholinopropyl, morpholinobutyl, group, etc.; preferred substituted aryl groups for $R_5$ include halogenophenyl groups such as chlorophenyl, bromophenyl, etc., phenyl groups substituted by a $C_1$–$C_4$ alkyl groups such as methylphenyl, ethylphenyl, butylphenyl, t-butylphenyl, etc., and phenyl groups substituted with an amino group, usually 1 or 2 amino groups, substituted by one or more alkyl groups having 1–4 carbon atoms; and preferred 2-substituted vinyl groups for $R_5$ include β-styryl, 2-(3-pyridyl)vinylidene, 2-(2-pyridyl)vinylidene and the like.

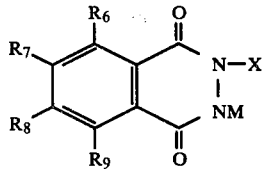

(II)

(wherein $R_6$, $R_7$, $R_8$ or $R_9$ each represents a hydrogen atom, a halogen atom, a hydroxy group, an alkyl group, an aryl group, an amino group, an alkyl-substituted amino group, a nitro group, an alkoxy group, a thioalkoxy group or an acylamide group, and X represents a hydrogen atom, an aryl group, a pyridyl group, a 2-(2-pyridyl)ethyl group, a 2-(4-pyridyl)ethyl group, a benzoyl group or a methyl group). In general formula (II), preferred halogen atoms for $R_6$, $R_7$, $R_8$ and $R_9$ include a chlorine atom, a bromine atome and the like, preferred alkyl groups include alkyl groups having 1–4 carbon atoms such as methyl, ethyl, propyl, isopropyl, butyl, t-butyl, etc.; preferred aryl groups include a phenyl group, a naphthyl group and the like; preferred alkyl-substituted amino groups include those which are substituted with alkyl groups having 1–4 carbon atoms such as methyl, ethyl, propyl, isopropyl, butyl, t-butyl, etc.; preferred alkoxy groups include alkoxy groups having 1–4 carbon atoms; e.g., a methoxy group, an ethoxy group, a propoxy group, an isopropoxy group, a butoxy group, a t-butoxy group and the like; preferred thioalkoxy groups include $C_1$–$C_{18}$ thioalkoxy groups, e.g., a thiomethoxy group, a thiobenzyloxy group and the like, and preferred acylamide groups include acylamide groups having 1–4 carbon atoms, e.g., an acetylamide group, a propionamide group, a butyrylamide group and so on. In addition, the aryl groups represented by X preferably include, for example, a phenyl group, a naphthyl group and the like.

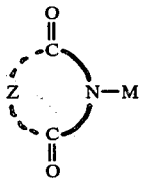

(III)

wherein Z represents an atomic group necessary to complete a heterocyclic ring, with a 5-membered ring being preferred.

—NH—N.R'''— are preferred Z groups, where R''' is preferably an aryl group, more particularly an aryl group having 6–12 carbon atoms, e.g., phenyl, tolyl, xylyl, and the like. Moreover,

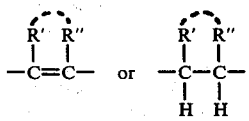

are also preferred as Z, where R' and R'' represent hydrogen atoms or atomic groups united with each other to form a moiety of an aromatic ring, for example, a phenylene group. The aromatic ring may be substituted with a 1–12 carbon atom containing group. Such substituted groups preferably include an alkyl, an alkoxyl, a cycloalkyl, an aralkyl, an aralkoxy group and the like.

Preferably M is formulae (I)—(III) is alkali metal such as sodium, lithium, rubidium or cesium, or potassium, and most preferably, M is hydrogen atom.

Aryl groups in the above formulae, be they aryl per se or an aryl moiety part of another group, e.g., in aralkyl, generally will have 6 to 18 carbon atoms, and a phenyl group is most preferred. When the aryl group is substituted, preferred substituents are an alkyl group and a halogen atom.

Specific examples of the compounds having an

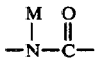

moiety which are preferably used in the practice of the present invention include:

Phthalazinone,
Sodium salt of phthalazinone,
Potassium salt of phthalazinone,
Lithium salt of phthalazinone,
4-Methylphthalazinone,
4-Phenylphthalazinone,
4-(1-Naphthyl)phthalazinone,
4-(2-Naphthyl)phthalazinone,
4-Hydroxymethylphthalazinone,
4-Chlorophthalazinone,
4-(p-Chlorophenyl)phthalazinone,
4-(p-Pyridino)phthalazinone,
4-Methoxyphthalazinone,
4-β-Styrylphthalazinone,
4-Dimethylaminomethylphthalazinone,
4-Morpholinomethylphthalazinone,
4-(p-Methoxybenzyl)phthalazinone,
4-(benzylidenehydrazino)phthalazinone,
4-(p-Dimethylaminophenyl)phthalazinone,
4-Benzylphthalazinone,
6-Chlorophthalazinone,
5,7-Dimethoxyphthalazinone,
8-Methylphthalazinone,
6-Bromophthalazinone,
2,3-Dihydro-1,4-phthalazinedinone,
Sodium salt of 2,3-dihydro-1,4-phthalazinedione,
5-Chloro-2,3-dihydro-1,4-phthalazinedinone,
5-Bromo-2,3-dihydro-1,4-phthalazinedione,
2,3-Dihydro-6-hydroxy-1,4-phthalazinedione,
2,3-Dihydro-5-hydroxy-1,4-phthalazinedione,
5-Amino-2,3-dihydro-1,4-phthalazinedione,
5-Acetoamide-2,3-dihydro-1,4-phthalazinedione,
6-Amino-2,3-dihydro-1,4-phthalazinedione,
2,3-Dihydro-2-phenyl-1,4-phthalazinedione,
2,3-Dihydro-2-(1-naphthyl)-1,4-phthalazinedione,
2,3-Dihydro-2-(2-naphthyl)-1,4-phthalazinedione,
2,3-Dihydro-5-nitro-1,4-phthalazinedione,
2,3-Dihydro-2-[2-(2-pyridyl)ethyl]-1,4-phthalazinedione,
2,3-Dihydro-2-[2-(4-pyridyl)ethyl]-1,4-phthalazinedione,
5-Dimethylamino-2,3-dihydro-1,4-phthalazinedione,
2,3-Dihydro-2-(2-pyridyl)-1,4-phthalazinedione,
2-(Benzoyl-2,3-dihydro-1,4-phthalazinedione, 2,3-Dihydro-2-methyl-1,4-phthalazinedione,
2,3-Dihydro-5-methyl-1,4-phthalazinedione,
2,3-Dihydro-6-methyl-1,4-phthalazinedione,
2,3-Dihydro-5-phenyl-1,4-phthalazinedione,
2,3-Dihydro-6-phenyl-1,4-phthalazinedione,
5-Bromo-2,3-dihydro-8-methoxy-1,4-phthalazinedione,
6-Benzoyl-2,3-dihydro-1,4-phthalazinedione,
5,6,7,8-tetraethyl-2,3-dihydro-1,4-phthalazinedione,
Succinimide,
Phthalimide,
Potassium salt of phthalimide,
2,4-Thiazolizinedione,
4-Methoxyphthalimide,
4-Ethoxyphthalimide,
4-tert-Butylphthalimide,
4-Hydroxyphthalimide,
4-Styrylphthalimide,
3-Methylphthalimide, and –
4-Benzoyloxyphthalimide.

The organic silver salts employed as component (a) in the invention are colorless, white or slightly colored silver salts which are comparatively stable to light and which react with a reducing agent to form silver images when heated to a temperature of about 80° C. or higher, preferably 100° C. or higher, in the presence of an exposed silver halide. Examples of organic silver salts include silver salts of organic compounds containing an imino group, a mercapto group, a thione group or a carboxyl group. Typical examples of these organic silver salts include:

(1) Silver salts of organic compounds containing an imino group:

Silver benzotriazole, silver nitrobenzotriazole, silver alkyl-substituted benzotriazoles (e.g., silver methylbenzotriazole), silver halogen-substituted benzotriazoles (e.g., silver bromobenzotriazole or silver chlorobenzotriazole), silver carboimide-substituted benzotriazoles (e.g.,

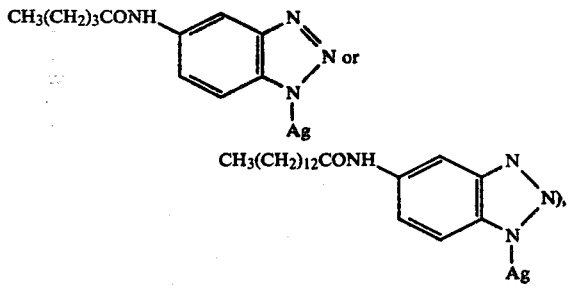

silver benzimidazole, silver substituted-benzimidazoles (e.g., silver 5-chlorobenzimidazole or silver 5-nitrobenzimidazole), silver carbazole, silver saccharin, silver phthalazinone, silver substituted-phthalazinone, silver salts of phthalimides, silver pyrrolidone, silver tetrazole and silver imidazole;

(2) Silver salts of organic compounds containing a mercapto group or a thione group:

Silver 3-mercapto-4-phenyl-1,2,4-triazole, silver 2-mercaptobenzimidazole, silver 2-mercapto-5-aminothiadiazole, silver 1-phenyl-5-mercaptotetrazole, silver 2-mercaptobenzothiazole, silver salts of the thioglycolic acids as described in Japanese Patent Application (OPI) 28221/73 (e.g., silver 2-(S-ethylenethioglycolamido)-benzothiazole or silver S-alkyl($C_{12}$–$C_{22}$) thioglycolates), silver salts of dithiocarboxylic acids (e.g., silver dithioacetate), silver thioamide, silver salts of thiopyridines (e.g., silver 5-carbethoxy-1-methyl-2-phenyl-4-thiopyridine), silver dithio dihydroxybenzole, silver mercaptotriazine, silver 2-mercaptobenzoxazole and silver mercaptooxadiazole, etc.;

(3) Silver salts of organic compounds containing a carboxylic group:

(a) Silver salts of aliphatic carboxylic acids:

Silver caprate, silver laurate, silver myristate, silver palmitate, silver stearate, silver behenate, silver maleate, silver fumarate, silver tartarate, silver furoate, silver linolate, silver oleate, silver hydroxystearate, silver adipate, silver sebacate, silver succinate, silver acetate, silver butyrate and silver camphorate;

(b) Silver aromatic carboxylates and others:

Silver benzoate, silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver salts of other substituted benzoic acids, silver gallate, silver tannate, silver phthalate, silver terephthalate, silver salicylate, silver phenylacetate, silver pyromellitate, silver 4'-n-octadecyloxydiphenyl-4-carboxylate, silver thionecarboxylates as disclosed in U.S. Pat. No. 3,785,830 and silver salts of aliphatic carboxylic acids containing a thioether group as disclosed in U.S. Pat. No. 3,330,663; (4) Other silver salts:

Silver 4-hydroxy-6-methyl-1,3,3a,7-tetraazaindene, silver 5-methyl-7-hydroxy-1,2,3,4,6-pentaazindene, silver tetraazindene as disclosed in British Pat. No. 1,230,642, silver S-2-aminophenylthiosulfate as disclosed in U.S. Pat. No. 3,549,379, metal-containing aminoalcohols as disclosed in British Pat. No. 1,349,595, and organic acid-metal chelates as disclosed in U.S. Pat. No. 3,794,496.

An oxidizing agent such as titanium dioxide, zinc oxide or gold carboxylates (e.g., aurous laurate, aurous stearate or aurous behenate) other than silver salts can be employed together with the organic silver salt, if desired.

Various processes are known for preparing such organic silver salts. One of the simplest processes for preparing them is described in U.S. Pat. No. 3,457,075 wherein a solution of an organic silver salt forming agent or a salt thereof in a water-miscible solvent, such as an alcohol or acetone, or water is mixed with an aqueous solution of a water-soluble silver salt such as silver nitrate to prepare an organic silver salt.

Further, it is possible to use the process described in U.S. Pat. No. 3,839,049 (equivalent to British Pat. No. 1,347,350) wherein a colloidal dispersion of an ammonium salt or an alkali metal salt of an organic silver salt forming agent is mixed with an aqueous solution of a water-soluble silver salt such as silver nitrate. In a similar process, it is possible to use an aqueous solution of a silver complex salt such as a silver amine complex salt or a solution of such a salt in a water-miscible solvent instead of the aqueous solution of the water-soluble silver salt such as silver nitrate.

Another process for preparing organic silver salts is the process described in U.S. Pat. No. 3,458,544. Namely, in this process, organic carboxylic acid silver salts are prepared by mixing a water difficultly-miscible solution (oily solution), such as a benzene solution of an organic carboxylic acid, with an aqueous solution of a silver complex salt. Preferably the water is added to the oily solution to form an emulsion prior to mixing the aqueous solution of the silver complex salt. This process can be also applied to the preparation of other organic silver salts.

A similar process has been described in Canadian Pat. No. 847,351 wherein the resulting organic silver salts are more stable to heat and light. In this process, a silver salt solution without using an alkali, such as an aqueous solution containing only silver nitrate, is used instead of the silver complex salt.

Further, a process for preparing organic silver salts is described in West German Patent Application (OLS) 2,402,906. This process is preferred because heat-developable light-sensitive materials containing the resulting organic silver salt do not form as much heat-fog (undesirable fog generated on the unexposed area when the light-sensitive material is heated). Namely, this process comprises mixing an emulsion composed of an aqueous solution of a salt (for example, an alkali metal salt such as a sodium salt, a potassium salt or a lithium salt or an ammonium salt, etc.) of a water-soluble organic silver salt forming agent and an oil (for example, benzene, toluene, cyclohexane, pentane, hexane, carboxylic acid esters such as an acetate, phosphoric acid esters, and oils such as castor oil, etc.) with a solution of, and preferably an aqueous solution of, a silver salt which is more water-soluble than the organic silver salt (such as silver nitrate) or a silver complex salt to prepare the organic silver salt. In another embodiment of this process, it is possible to prepare the organic silver salt by mixing an aqueous alkali solution (for example, an aqueous solution of sodium hydroxide) with an oil-soluble solution of an organic silver salt forming agent (for example, a toluene solution of the organic silver salt forming agent) and mixing the resulting emulsion with a solution, and preferably an aqueous solution, of a soluble silver salt such as silver nitrate or a silver complex salt such as a silver ammine complex salt.

The oils which can be used for the above-described oily solution include the following compounds:

(1) Phosphoric acid esters: For example, tricresyl phosphate, tributyl phosphate, and monooctyl dibutyl phosphate, etc.

(2) Phthalic acid esters: For example, diethyl phthalate, dibutyl phthalate, dimethyl phthalate, dioctyl phthalate and dimethoxyethyl phthalate, etc.;

(3) Carboxylic acid esters: For example, acetates such as amyl acetate, isopropyl acetate, isoamyl acetate, ethyl acetate, 2-ethylbutyl acetate, butyl acetate and propyl acetate, etc.; sebacates such as dioctyl sebacate, dibutyl sebacate, and diethyl sebacate, etc.; succinates such as diethyl succinate; formates such as ethyl formate, propyl formate, butyl formate and amyl formate, etc.; tartarates such as diethyl tartarate; valerates such as ethyl valerate; butyrates such as methyl butyrate, ethyl butyrate, butyl butyrate and isoamyl butyrate; and adipic acid esters, etc.;

(4) Oils such as castor oil, cotton seed oil, linseed oil and tsubaki oil, etc.;

(5) Aromatic hydrocarbons such as benzene, toluene and xylene, etc.;

(6) Aliphatic hydrocarbons such as pentane, hexane and heptane, etc.; and (7) Cyclic hydrocarbons such as cyclohexane.

Examples of silver complex salts include silver ammine complex salt, silver methylamine complex salt and silver ethylamine complex salt, and preferably alkali-soluble complex salts having a dissociation constant higher than the organic silver salts are suitably used.

Examples of solvents for the silver salts such as silver nitrate include not only water but also polar solvents such as dimethyl sulfoxide, dimethylformamide and acetonitrile, etc.

Further, ultrasonic waves can be employed during the preparation of the organic silver salts as described in West German Patent Application (OLS) 2,401,159. Particularly, emulsification can be easily carried out by applying ultrasonic waves when it is desired to emulsify water and oils. Further, it is possible to use surface active agents for the purpose of controlling the particle size of the organic silver salts during the preparation thereof.

The organic silver salts can also be prepared in the presence of polymers. A specific process has been described in U.S. Pat. No. 3,700,458, which comprises mixing a non-aqueous solution of an organic carboxylic acid with a non-aqueous solution of a heavy metal salt of trifluoroacetate or tetrafluoroborate in the presence of a polymer to produce a heavy metal salt of the organic carboxylic acid, such as a silver salt thereof. A process which comprises reacting a colloid dispersion of an organic silver salt forming agent with an aqueous solution of silver nitrate has been described in U.S. Pat. No. 3,839,049. Furthermore, a process for producing an emulsion using similar non-aqueous solutions has been described in U.S. Pat. No. 3,748,143. In addition, it is possible, as described in Japanese Patent Application (OPI) 13224/1974 and West German Patent Application (OLS) 2,322,096, to change the particle form, the particle size and photographic properties such as light stability or sensitivity of the organic silver salt due to the presence of a metal salt or a metal complex, such as a mercury or lead compound during the preparation of the organic silver salts.

In addition, the coexistence of metal salts or metal complexes containing mercury, lead or the like with organic silver salts at the time of preparation thereof can make it possible to control grain form, grain size and photographic characteristics such as thermal fog, light-stability, sensitivity and so on, as disclosed in the specifications of Japanese Patents Application (OPI) 13224/74 and U.S. Pat. No. 3,997,597.

It has been also confirmed that cobalt, manganese, nickel, iron, rhodium, iridium, platinum, gold, cadmium, zinc, lithium, copper, thallium, tin, bismuth, antimony, chromium, ruthenium, palladium and osmium, in addition to the mercury and lead described above, are effective as the metal. In order to use these metal containing compounds, a mixture or dispersion of a solution of a silver salt forming organic compound and a metal containing compound can be mixed with an aqueous solution of a soluble silver salt such as silver nitrate or an aqueous solution of a silver complex salt such as a silver ammine complex salt. Further, a solution or dispersion of the metal containing compound can be mixed with an aqueous solution of the silver salt or a silver complex salt and a solution or dispersion of the silver salt forming organic compound. Furthermore, a method comprising mixing a solution or dispersion of the silver salt forming organic compound with a solution or dispersion of a mixture of the silver salt or silver complex salt and the metal containing compound is also preferred. A preferred amount of the metal containing compound ranges from about $10^{-6}$ to $10^{-1}$ mols per mol of the organic silver salt and from about $10^{-5}$ to $10^{-2}$ mols per mol of the silver halide.

The particle size of the thus-resulting organic silver salts is about 0.01 micron to about 10 microns as the longer diameter, preferably about 0.1 micron to about 5 microns.

Examples of light-sensitive silver halides which can be employed as component (b) in the invention include silver chloride, silver bromide, silver iodide, silver chlorobromoiodide, silver chlorobromide, silver chloroiodide, silver iodobromide and a mixture thereof. The light-sensitive silver halide can be coarse particles or fine particles, but preferably is fine particles. A preferred particle size of the silver halide is about 0.001 to 1 micron, more preferably about 0.01 to 0.5 micron, in the longer diameter.

These silver halides will be effective when used in concentrations ranging from about 0.001 mole to about 0.5 mole, preferably from about 0.01 mole to about 0.3 mole, per mole of organic silver salt.

The light-sensitive silver halide can be prepared by any of the procedures known in the field of photography, such as a single jet procedure and a double jet procedure. Examples of silver halides used in this invention include these prepared by a Lippmann process, an ammoniacal process and a thiocyanate or thioether ripening process. The silver halide used can be unwashed or washed, e.g., with water, alcohols, etc., to remove soluble salts.

The silver halide used in the invention can be chemically sensitized with a chemical sensitizer such as sulfur, selenium, tellurium, gold, platinum, palladium, a stannous halide, etc., e.g., as disclosed in U.S. Pat. Nos. 1,623,499, 2,399,083 and 3,297,447. The silver halide preferably contains an antifoggant or a stabilizer such as a thiazolium salt, an azaindene, a mercury salt, a urazole, a sulfocatechol, an oxime, a nitron, a nitroindazole, etc., to stabilize the silver halide to fog, e.g., as disclosed in U.S. Pat. Nos. 2,728,663, 2,839,405, 2,566,263, 2,597,915 and British Pat. No. 623,448.

The silver halide emulsion prepared in advance can be mixed with an oxidation-reduction composition comprising an organic silver salt and a reducing agent, as described in U.S. Pat. No. 3,152,904. According to this method, however, sufficient contact is not attained between the silver halide and the organic silver salt (e.g., as disclosed in U.S. Pat. No. 3,457,075). In order to achieve good contact between the silver halide and the organic silver salt, various techniques can be employed. One effective technique is to mix the materials in the presence of a surface active agent, as described in Japanese Patent Application (OPI) 32926/75 and (OPI) 32928/75. According to another method a silver halide is prepared in the presence of a polymer and then mixed with an organic silver salt (for example, as disclosed in U.S. Pat. Nos. 3,705,565, 3,713,833, 3,706,564 and 3,761,273, French Pat. Nos. 2,107,162 and 2,078,586, and Belgian Pat. No. 774,436).

The light-sensitive silver halide employed in the invention can be simultaneously prepared with the preparation of the organic silver salt as disclosed in Japanese Patent Application (OPI) 17216/75. That is, the silver halide can be prepared by mixing a silver salt (e.g., silver nitrate or a silver complex salt) solution with a solution or dispersion of an organic silver salt-forming compound or a salt thereof and a silver halide forming compound solution, or by mixing halide-forming compound solution and a solution or dispersion of an organic silver salt-forming compound or a salt thereof and a solution of a silver salt such as silver nitrate or a silver complex salt, whereby silver halide is prepared simultaneously with the organic silver salt. Further, the light-sensitive silver halide employed in the invention can be prepared by a partial conversion of the organic silver salt by subjecting a solution or dispersion of the previously prepared organic silver salt to a silver halide forming compound or a sheet material containing an organic silver salt with a silver halide forming compound. The thus-prepared silver halide is effectively contacted with the organic silver salt to provide preferred results as disclosed in U.S. Pat. No. 3,457,075.

The light-sensitive silver halide forming components which can be employed in this invention include any compounds capable of forming silver halide on reaction with the organic silver salt. Whether the compounds can be employed as a silver halide forming component can be determined by a routine test. For example, after mixing a compound for forming a silver halide with the organic silver salt, and if necessary heating, the X-ray diffraction pattern obtained by an X-ray diffraction method is examined to determine whether diffraction peaks inherent to silver halide are present. If so, the compound is useful.

Examples of silver halide forming components include the following compounds.

(1) Inorganic halides:

For example, halides represented by the formula $MX'_n$, wherein M represents H, $NH_4$ or a metal atom, X' represents Cl, Br or I, and n is 1 if M represents H or $NH_4$, or n represents the valence of the metal atom if M represents a metal atom. Examples of suitable metal atoms include lithium, sodium, potassium, rubidium, cesium, copper, gold, beryllium, magnesium, calcium, strontium, barium, zinc, cadmium, mercury, aluminium, gallium, indium, thallium, germanium, tin, lead, antimony, bismuth, chromium, molybdenum, tungsten, manganese, rhenium, iron, cobalt, nickel, ruthenium, rhodium, palladium, osmium, iridium and platinum.

(2) Halogen containing metal complexes:

For example, $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $(NH_4)_3RhCl_6$ and $(NH_4)_3RhBr_6$, etc.

(3) Onium halides:

For example, quaternary ammonium halides such as trimethylphenyl ammonium bromide, cetylethyldimethyl ammonium bromide and trimethylbenzyl ammonium bromide, quaternary phosphonium halides such as tetraethyl phosphonium bromide and tertiary sulfonium halides such as trimethyl sulfonium iodide. Further, these onium halides can be used in final coating dispersions for the purpose of decreasing sensitivity or, if desired, decreasing the background density, as described in U.S. Pat. No. 3,679,422.

(4) Halogenated hydrocarbons:

For example, iodoform, bromoform, carbon tetrabromide and 2-bromo-2-methylpropane, etc.

(5) N-halogen compounds:

For example, compounds represented by the following formulae:

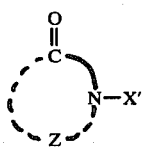

(II)

-continued and

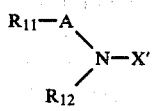

(III)

wherein X' represents Cl, Br or I; Z represents a group of atoms necessary to form a 5- or 6-membered ring, wherein the 5- or 6-membered ring may be condensed with another ring; A represents a carbonyl group or a sulfonyl group; and $R_{11}$ and $R_{12}$ each represensts an alkyl group, an aryl group or an alkoxy group. For example, N-bromosuccinimide, N-bromophthalimide, N-bromoacetamide, N-iodosuccinimide and N-bromophthaladinone, etc., are suitable. These compounds have been described in detail in West German Patent Application (OLS) 2,453,131. In addition, N-halo compounds of benzotriazole and substituted benzotriazoles such as the alkyl, nitro, halo, imido or amino substituted benzotriazoles are also effective. Furthermore, N-bromobenzimidazoles are suitable.

(6) Other halogen containing compounds:
For example, triphenylmethyl chloride, triphenylmethyl bromide, 2-bromobutyric acid, 2-bromoethanol and dichlorobenzophenone, etc.

Moreover, the use of conductive polymers of the onium halide series as the light-sensitive silver halide forming component can provide light-sensitive materials with both heat developable light-sensitive and electro-sensitive properties.

In the above-described processes and the process of the present invention, the improvement of photographic properties, such as increase of sensitivity and elimination of heat-fog, etc., can be achieved by ripening by allowing the composition to stand at room temperature (about 20°–25° C.) to higher temperature (30°° C.–80° C.) for a suitable time (for example, 20 minutes to 48 hours) after addition of the silver halide forming component.

Optionally, the presence of thiosulfates and other sulfur-containing compounds, metals such as gold, chromium, tin, lithium, palladium, etc., reducing agents or the combination composition thereof is effective out for improving the photographic characteristics of light-sensitive materials, for example, for increasing the sensitivity thereof and for reducing thermal fog.

The silver halide forming compound can be employed individually or as a combination thereof. A suitable amount of the silver halide forming component is about 0.001 to about 0.5 mol, preferably about 0.01 to 0.3 mol, per mol of the organic silver salt employed as the component (a). If the amount is more than about 0.5 mol, the color changes, which is an undesirable coloration of the background which occurs on allowing the exposed and developed light-sensitive material to stand under normal room illumination. If the amount is less than about 0.001, the sensitivity is reduced.

When the silver halide is prepared by any of the above-described methods, the resulting silver halides may be chemically sensitized with chemical sensitizers such as sulfur, selenium, tellurium, gold, platinum, palladium, etc., compounds, reducing agents such as tin halides, or the combinations thereof, which are disclosed, for example, in U.S. Pat. Nos. 1,623,499, 2,399,083 and 3,297,447.

Moreover, optical sensitizing dyes which are known to be useful for gelatin-silver halide emulsions can also be added to the present heat developable light-sensitive materials in order to further increase their sensitivity. Effective optical sensitizing dyes include cyanine, merocyanine, complex (trinuclear or tetranuclear) cyanine, holopolar cyanine, styryl, hemicyanine, oxonol, hemioxonol and like dyes. Of the cyanine dyes, basic nucleus-containing dyes such as thiazoline, oxazoline, pyrroline, pyridine, oxazole, thiazole, selenazole, imidazole, etc., dyes are most preferred. These basic nuclei may be substituted with an alkyl group, an alkylene group, a hydroxyalkyl group, a sulfoalkyl group, a carboxyalkyl group, an aminoalkyl group or an emamine group which can form a condensed carbon ring or a heterocyclic ring. These cyanine dyes can have a symmetric or asymmetric chemical structure, and alkyl groups, enamine groups or heterocyclic substituted groups may be substituted on a methine chain or a polymethine chain. Carboxyl group-containing cyanine dyes are particularly effective to increase sensitivity.

In addition to the above-mentioned basic nuclei, a merocyanine dye can have an acidic nucleus such as thiohydantoin, rhodanine, oxazolidinedione, thiazolidinedione, barbituric acid, thiazolineone, malononitrile, or pyrazolone nucleus. These acidic nuclei may further be substituted by alkyl groups, alkylene groups, phenyl groups, carboxyalkyl groups, sulfoalkyl groups, hydroxyalkyl groups, alkoxyalkyl groups, alkylamine groups or heterocyclic nuclei. Imino group- or carboxyl group-containing merocyanine dyes are particularly preferred for increasing sensitivity. These dyes can be used as combinations thereof, if desired. Further, supersensitizing additives which do not absorb visible light as disclosed in, for example, U.S. Pat. Nos. 2,933,390 and 2,937,089, and which include ascorbic acid derivatives, azaindene, cadmium salts, organic sulfonic acids and the like can be used in combination therewith, if desired. Particularly suitable sensitizing dyes for the heat developable light-sensitive materials of the present invention include merocyanine dyes which have a rhodanine, a thiohydantoin or a 2-thio-2,4-oxazolizinedione nucleus, as disclosed in U.S. Pat. No. 3,761,279. Specific examples thereof are 3-p-carboxyphenyl-5-[β-ethyl-2-(3-benzoxazolylidene)ethylidene]rhodanine, 5-(3-β-carboxyethyl-2-(3-thiazolinylidene)ethylidene]-3-ethylrhodanine, 3-carboxymethyl-5-[(3-methylthiazolinylidene)-α-ethyl-ethylidene]-rhodanine, 1-carboxymethyl-5-[(3-ethyl-2-(3H)-benzooxazolylidene)-ethylidene]-3-phenyl-2-thiohydantoin, 5-[(3-ethyl-2-benzoxazolynidene)-1-methyl-ethylidene]-3-[(3-pyrroline-1-yl)propyl]-rhodanine, 3-ethyl-5-[(3-ethyl-2-(3H)-benzothiazolylidene)-isopropylidene]-2-thio-2,4-oxazolizinedione, etc.

Other effective sensitizing dyes for the heat developable light-sensitive materials of the present invention include trinuclear merocyanine dyes as are disclosed in U.S. Pat. No. 3,719,495, polycyclic aromatic dyes as are disclosed in Belgian Pat. No. 788,695, sensitizing dyes suited for silver iodide emulsions as are disclosed in Japanese Patent Laid-Open 17719/74, styrylquinoline series dyes as are disclosed in Japanese Patent Laid-Open 84637/74, rhodacyanine dyes as are disclosed in German OLS 2,405,713, acidic dyes such as 2',7'-dichlorofluorescein dyes as are disclosed in German OLS 2,401,982 and 2,404,591 and Japanese Patent Applications (OPI) 2924/75 and (OPI) 29029/75, and merocyanine dyes as are disclosed in Japanese Patent Applications (OPI) 104637/75, (OPI) 105127/75 and (OPI)

56424/75. Specific examples of especially preferred pyrazolone nuclei-containing merocyanine dyes are as follows:

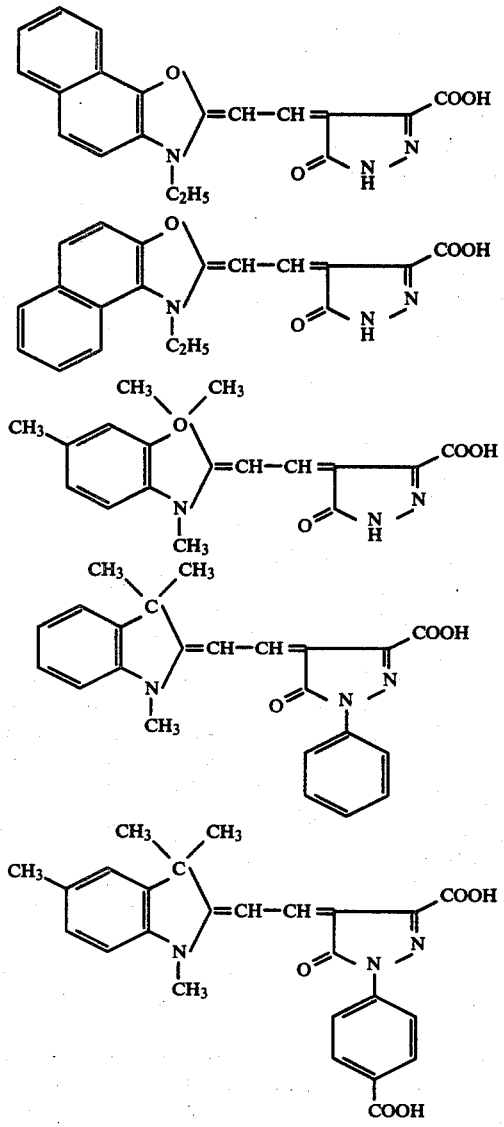

The above described dyes are most effective when used at a concentration ranging from about $10^{-4}$ mole to about 1 mole per mole of the silver halide or silver halide-forming component used as component (b) in the present invention.

The reducing agent (component (c)) used in the heat developable light-sensitive materials of the present invention is a compound capable of reducing the organic silver salt component (a) when heated in the presence of an exposed silver halide and can be suitably selected depending upon the organic silver salt (component (a)) with which it is used in combination. Examples of such reducing agents include substituted phenols, substituted or unsubstituted bisphenols, substituted or unsubstituted mono- or bisnaphthols, di- or polyhydroxybenzenes, di- or polyhydroxynaphthalenes, hydroquinone monoethers, ascorbic acid and derivatives thereof, 3-pyrazolidones, pyrazolin-5-ones, reducing saccharides, aromatic primary amino compounds, reductones, kojic acid, hinokitiol, hydroxylamines, hydroxytetronic acids, hydroxytetronic acid amides, hydroxamic acids, sulfohydrooxamic acids, hydrazides, indan-1,3-diones and p-oxyphenylglycines, etc. Of these reducing agents, reducing agents which are photolytically decomposed are preferred. Photolytically decomposable reducing agents are described in U.S. Pat. No. 3,827,889. Further, it is possible to use the reducing agents together with compounds which accelerate the photolysis, as described in U.S. Pat. No. 3,756,829. Blocked bisphenol type reducing agents are also used as preferred compounds and have been described in, for example, U.S. Pat. No. 3,589,903 and Japanese Patent Applications (OPI) 36110/75 and (OPI) 116023/75. Other examples of the reducing agents which can be used in the present invention are described in U.S. Pat. Nos. 3,152,904, 3,457,075, 3,531,286, 3,615,533, 3,679,426, 3,672,904, 3,751,252, 3,751,255, 3,782,949, 3,770,448 and 3,773,512, U.S. Pat. No. 3,819,382 and Belgian Pat. No. 786,086.

Examples of suitable reducing agents are as follows:

(1) Substituted phenols:

Aminophenols, for example, 2,4-diaminophznol, methylaminophenol, p-aminophenol, o-aminophenol, 2-methoxy-4-aminophenol and 2-$\beta$-hydroxyethyl-4-aminophenol, etc.; alkyl-substituted phenols, for example, p-t-butylphenol, p-t-amylphenol, p-cresol, 2,6-di-t-butyl-p-cresol, p-ethylphenol, p-sec-butylphenol, 2,3-dimethylphenol, 3,4-xylenol, 2,4-xylenol, 2,4-di-t-butylphenol, 2,4,5-trimethylphenol, p-nonylphenol and p-octylphenol, etc.; other phenols, for example, p-acetophenol, p-acetoacetyl-4-methylphenol, 1,4-dimethoxyphenol, 2,6-dimethoxyphenol, chlorothymol, 3,5-di-t-butyl-4-hydroxybenzyl-dimethylamine, and sulfonamidophenols, for example, compounds described in U.S. Pat. No. 3,801,321, and novolak resin type reaction products of formaldehyde and phenol derivatives (for example, 4-methoxyphenol, m-cresol, o- or p-butylphenol, 2,6-di-t-butylphenol and mixtures thereof, etc.);

(2) Substituted or unsubstituted bis-, tris- and tetrabisphenols: o-bis-Phenols, for example, 1,1-bis-(2-hydroxy-3,5-dimethylphenyl)-3,5-trimethylhexane, bis-(2-hydroxy-3-t-butyl-5-methylphenyl)methane, bis-(2-hydroxy-3,5-di-t-butylphenyl)methane, bis-(2-hydroxy-3-t-butyl-5-ethylphenyl)methane, 2,6-methylene-bis-(2-hydroxy-3-t-butyl-5-methylphenyl)-4-methylphenol, 1,1-bis-(5-chloro-2-hydroxyphenyl)methane, 2,2'-methylene-bis-[4-methyl-6-(1-methylcyclohexyl)-phenol], 1,1-bis-(2-hydroxy-3,5-dimethylphenyl)-2-methylpropane, 1,1,5,5-tetrakis-(2-hydroxy-3,5-dimethylphenyl)-2,4-ethylpentane and 3,3',5,5'-tetramethyl-6,6'-dihydroxytriphenylmethane; p-bis-phenols, for example, bisphenol A, 4,4'-methylene-bis-(3-methyl-5-t-butylphenol), 4,4'-methylene-bis-(2,6-di-t-heptylidene)-di-(o-cresol), 4,4'-ethylidene-bis-(2,6-di-tert-butylphenol), 4,4'-(2-butylidene)-di-(2,6-xylenol), 4,4'-(p-methylbenzylidene)-di-(o-cresol), 4,4'-(p-methoxybenzylidene)-bis-(2,6-di-tert-butylphenol), 4,4'-(p-nitrobenzylidene)-di-(2,6-xylenol) and 4,4'-(p-hydroxybenzylidene)-di-(p-cresol); and others, for example, 3,5-di-t-butyl-4-hydroxybenzylidimethylamine, polyphenols such as $\alpha,\alpha'$-(3,5-di-t-butyl-4-hydroxyphenyl)dimethylether, 2,4,6-tris-(3,5-di-t-butyl-4-hydroxybenzyl)-phenol, N,N'-di-(4-hydroxyphenyl)-urea and tetrakis-[methylene-(3,5-di-t-butyl-4-hydroxyhydrocinnamate]methane, diethylstilbestrol, hexestrol, bis-(3,5-di-t-butyl-4-hydroxybenzyl)ether and 2,6-bis-(2'-hydroxy-3'-t-butyl-5'-hydroxybenzyl)-4-methylphenol, etc.

(3) Substituted or unsubstituted mono- or bis-naphthols and di- or polyhydroxynaphthalenes: bis-β-Naphthols, for example, 2,2'-dihydroxy-1,1'-binaphthyl, 6,6'-dibromo-2,2'-dihydroxy-1,1'-binaphthyl, 6,6'-dinitro-2,2'-dihydroxy-1,1'-binaphthyl, bis-(2-hydroxy-1-naphthyl)methane and 4,4'-dimethoxy-1,1'-dihydroxy-2,2'-binaphthyl; naphthols, for example, α-naphthol, β-naphthol, 1-hydroxy-4-aminonaphthalene, 1,5-dihydroxynaphthalene, 1,3-dihydroxynaphthalene, 1-hydroxy-2-phenyl-4-methoxynaphthalene, 1-hydroxy-2-methyl-4-methoxy-naphthalene, 1-hydroxy-4-methoxynaphthalene, 1,4-dihydroxynaphthalene, methylhydroxynaphthalene, sodium 1-amino-2-naphthol-6-sulfonate, 1-naphthylamine-7-sulfonic acid and sulfonamidonaphthols.

(4) Di - or polyhydroxybenzenes and hydroquinone-monoethers (e.g., as described in, for example, U.S. Pat. No. 3,801,321):

Hydroquinone; alkyl substituted hydroquinones, for example, methylhydroquinone, t-butylhydroquinone, 2,5-dimethylhydroquinone, 2,6-dimethylhydroquinone and t-octylhydroquinone, etc.; halogen-substituted hydroquinones, for example, chlorohydroquinone, dichlorohydroquinone and bromohydroquinone, etc.; alkoxy-substituted hydroquinone, for example, methoxyhydroquinone and ethoxyhydroquinone, etc.; other substituted hydroquinones, for example, phenylhydroquinone and hydroquinone monosulfonate, etc.; hydroquinone monoethers, for example, p-methoxyphenol, p-ethoxyphenol, hydroquinone monobenzyl ether, 2-t-butyl-4-methoxyphenol, 2,5-di-t-butyl-4-methoxyphenol, hydroquinone mono-n-propyl ether and hydroquinone mono-n-hexyl ether; and others, for example, catechol, pyrogallol, resorcinol, 1-chloro-2,4-dihydroxybenzene, 3,5-di-t-butyl-2,6-dihydroxybenzoic acid, 2,4-dihydroxybenzoic acid, 2,4-dihydroxyphenyl sulfide, methyl gallate, and propyl gallate, etc.

(5) Ascorbic acid and derivatives thereof:

l-Ascorbic acid; isoascorbic acid; ascorbic acid monoesters, for example, ascorbic acid monolaurate, monomyristate, monopalmitate, monostearate and monobehenate; ascorbic acid diesters, for example, ascorbic acid dilaurate, dimyristate, dipalmitate and distearate; and the compounds described in U.S. Pat. No. 3,337,342.

(6) 3-Pyrazolines and pyrazolones:

For example, 1-phenyl-3-pyrazolidone, 4-methyl-4-hydroxymethyl-1-phenyl-3-pyrazolidone, the compounds described in British Pat. No. 930,572, and 1-(2-quinolyl)-3-methyl-5-pyrazolone, etc.

(7) Reducing sacchalides:

For example, glucose and lactose, etc.

(8) Aromatic primary amino compounds:

Examples of typical compounds include the phenylenediamines such as the N,N-dialkyl-p-phenylenediamines such as N-phenyl-N'-isopropyl-p-phenylenediamine, etc., which can provide color images particularly by the combined use of phenolic or active methylenic color couplers as disclosed in U.S. Pat. No. 3,531,286, and which may also provide color images according to the process disclosed in U.S. Pat. No. 3,761,270. Further examples include N,N-diethyl-p-phenylenediamine, 2-amino-5-diethylaminotoluene, 2-amino-5-(N-ethyl-N-laurylamino)-toluene, 4-[N-ethyl-N-(β-hydroxyethyl-)amino]aniline and 3-methyl-4-amino-N-ethyl-N-(β-hydroxyethyl)aniline, 4-amino-3-methyl-N-ethyl-N-(β-methanesulfoamidoethyl)aniline sesquisulfate monohydrate as described in U.S. Pat. No. 2,193,015, N-(2-amino-5-diethylaminophenylethyl)methanesulfoamide sulfate as described in U.S. Pat. No. 2,592,364, N,N-dimethyl-p-phenylenediamine hydrochloride and 3-methyl-4-amino-N-ethyl-N-methoxyethylaniline as described in Japanese Patent Application (OPI) 64933/1973, and the inorganic salts thereof. These compounds have been described in L.F.A. Mason, *Photographic Processing Chemistry,* pages 226–229, Focal Press, London (1966).

(9) Hydroxylamines:

For example, N,N-di-(2-ethoxyethyl)hydroxylamine, etc.

(10) Reductones:

Anhydro-dihydroaminohexose reductones as described in, for example, U.S. Pat. No. 3,679,426, and linear aminoreductones as described in Belgian Pat. No. 786,086.

(11) Hydroxamic acids:

For example, hydroxamic acids as described in U.S. Pat. Nos. 3,751,252 and 3,751,255.

(12) Hydrazides:

For example, hydroxy substituted aliphatic acid aryl hydrazides as described in U.S. Pat. No. 3,782,949.

(13) Other compounds:

For example, kojic acid, hinokitiol, hydroxytetronic acid, hydroxytetronamides, sulfohydroxaminic acids, p-oxyphenylglycine; and so on.

Specific examples of other reducing agents which may be employed in the practice of the present invention are disclosed in U.S. Pat. Nos. 3,152,904, 3,457,075, 3,531,286, 3,615,533, 3,679,426, 3,672,904, 3,751,252, 3,751,255, 3,782,949, 3,770,448 and 3,773,512, British Pat. No. 1,338,427, Belgian Pat. No. 786,086, German Patent OLS 2,031,748.

Of these reducing agents, the compounds having an alkyl group (e.g., a methyl group, an ethyl group, a propyl group, an isopropyl group, a butyl group or an amyl group) on at least one position adjacent to the position at which a hydroxyl group is bonded to an aromatic nucleus are preferred because they are stable to light and color changes due to exposure to light is small. For example, mono-, bis-, tris or tetrakis phenols having a 2,6-di-tert-butyl-phenol group are preferred examples of reducing agents. Typical examples of these compounds are (i) esters of carboxylic acids derived from phenols having a bulky substitutent in at least one ortho-position with mono-hydric or poly-hydric alcohols or phenols, and (ii) esters of alcohols derived from phenols having a bulky substituent in at least one ortho-position or phenols having a bulky substituent in at least one ortho-position with mono- or polycarboxylic acids. These esters can be presented by the formulae:

(IV)

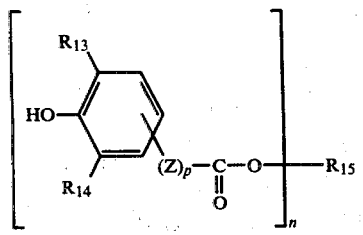

-continued (V)

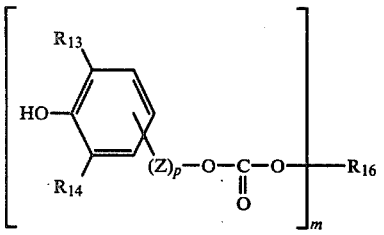

wherein Z is a di-valent group containing up to 30 carbon atoms, $R_{13}$ is an alkyl group having 1 to 20 carbon atoms, $R_{14}$ is a hydrogen atom or an alkyl group having 1 to 20 carbon atoms, $R_{15}$ is an alcohol residue, $R_{16}$ is a carboxylic acid residue, n and m each is a positive integer which is equal to the number of alcohol and carboxylic acid residues, respectively, esterified, and p is 0 or 1. Specific examples of these compounds includes tetrakis[methylene-(3,5-di-tert-butyl-4-hydroxyhydrocinnamate)]methane and octadecyl-3-(3',5'-di-tert-butyl-4'-hydroxyphenyl)-propionate.

It has been found that, of these esters, those represented by the following general formula (VI) provide an increased image density and desirable black tone when used in combination with phthalazinones, which can be present in the composition according to the invention as a particularly desirable activator toning agent as described hereinafter.

(VI)

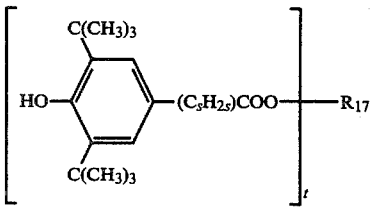

wherein s represents 1,2,3 or 4, $C_sH_{2s}$ has its carbon atom directly attached to the phenyl nucleus, which has at least one hydrogen atom, $R_{17}$ represents a saturated acyclic aliphatic alcohol residue having the formula $C_dH_{2d+2-t}$ where d represents an integer number ranging from 1 to 18, and t represents an integer ranging from 1 to 2d+2.

Other preferred reducing agents which can be used in combination with phthalazinone include bisphenols having a 2,6-di-t-alkylphenol group, a 2,4-di-t-butylphenol group or 2,4-di-t-amylphenol group. For example, there are the following compounds:

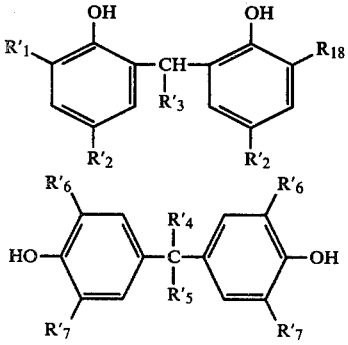

wherein $R_1'$ and $R_2'$ each represents a methyl, an ethyl, a propyl, an isopropyl, a t-butyl or a t-amyl group, and $R_3'$, $R_4'$, $R_5'$, $R_6'$ and $R_7'$ each represents a hydrogen atom or an alkyl group having 1 to 8 carbon atoms, where at least either $R_6'$ or $R_7'$ represents an alkyl group.

Reducing agents which may easily be decomposed by exposure to light are preferably used because they no longer act as reducing agents and do not cause the discoloration when allowed to stand in the light after development to undergo decomposition thereof, as disclosed in British Pat. No. 1,163,187. Reducing agents which may readily undergo photolysis include ascorbic acid and the derivatives thereof, furoin, benzoin, dihydroxyacetone, glyceraldehyde, tetrahydrorhozizoic acid, 4-methoxy-1-naphthol and so on.

Direct positive images can be obtained when heat-developable light-sensitive materials containing these photolytic reducing agents are image-exposed to result in the decomposition of reducing agents, as disclosed in Japanese Patent Publication 22185/70 and U.S. Pat. No. 3,756,829.

Further, photolysis-accelerating compounds for these reducing agents can be used in combination therewith. Moreover, reducing agents such as blocked bisphenol series compounds as disclosed in U.S. Pat. Nos. 3,589,903 and 3,756,829, Japanese Patent Applications (OPI) 36110/75 and (OPI) 116023/75, and the like may also be used.

A suitable reducing agent used is selected based on the combination of the organic silver salt employed as the component (a) with which the reducing agent is used. For example, a strong reducing agent is suitable for a silver salt such as a silver salt of benzotriazole or silver behenate, which are comparatively difficult to reduce, and a weak reducing agent is suitable for a silver salt such as silver caprate or silver laurate, which are comparatively easy to reduce. That is, once the organic silver salt is determined, the reducing agent can be selected depending on the organic silver salt. Suitable reducing agents for silver benzotriazole are 1-phenyl-3-pyrazolidones, ascorbic acid, ascorbic acid monoesters and naphthols such as 4-methoxy-1-naphthols. Suitable reducing agents for silver behenate are o-bisphenols and hydroquinone. Suitable reducing agents for silver caprate and silver laurate are substituted tetrakispenols, p-bisphenols such as substituted bisphenol A, and p-phenylphenol. The selection of an appropriate reducing agent for the organic silver salt can be facilitated by using two or more reducing agents.

The amount of the reducing agent used in the invention can widely vary depending on the kind of organic silver salt used, the kind of reducing agent used and the other additives present, but the amount of the reducing agent is generally about 0.05 to about 10 mols, preferably about 0.1 to 3 mols per mol of the organic silver salt.

Two or more reducing agents can be used. Examples of the two or more reducing agents used in combination are disclosed in Japanese Patent Application (OPI) 115540/74, and U.S. Pat. Nos. 3,667,958 and 3,751,249. It has also been confirmed that the development can be accelerated by using the reducing agent in combination with a tin compound, an iron compound, a cobalt compound, or a nickel compound.

If desired, an auxiliary reducing agent can be used in combination with the reducing agent employed. The amount of the auxiliary reducing agent to be used in the invention can be varied over a wide range, depending on the reducing power of the reducing agent and the reducibility of the organic silver salt used, but a suitable amount of the auxiliary reducing agent generally is from about $10^{-5}$ to 1 mole, preferably from $10^{-3}$ to 0.8 mole, per mole of the main reducing agent. Examples of effective combinations of reducing agents include a combination of o- or p-bisphenols and the above described esters selected from the group consisting of esters of mono- or polyhydric phenols or alcohols with carboxylic acids derived from phenols having at least one bulky ortho-substituent, and esters of mono- or polycarboxylic acids with polyhydric phenols having at least one bulky ortho-substituent or alcohols derived from phenols having at least one bulky ortho-substituent. By use of this combination, a heat developable light-sensitive element having reduced heat-fogging, increased whiteness and improved light stability after development can be obtained.

Preferably each component used in the present invention is included in a binder so as to provide a homogeneous film on a support. Although preferred binders are generally hydrophobic, hydrophilic binders can also be used. These binders are transparent or semi-transparent. For example, proteins such as gelatin or gelatin derivatives, cellulose derivatives, polysaccharides such as dextran, natural materials such as gum arabic, latex vinyl compounds which increase the dimensional stability of the photographic materials and synthetic polymers described hereinafter can be used. Preferred synthetic polymers are those described in U.S. Pat. Nos. 3,142,586, 3,193,386, 3,062,674, 3,220,844, 3,287,289 and 3,411,911. Effective polymers include water-insoluble polymers of alkyl acrylates and methacrylates, acrylic acid, sulfoalkyl acrylates or methacrylates, and compounds having a repeating sulfobetaine unit as described in Canadian Pat. No. 774,054. Examples of preferred high molecular weight materials and resins include polyvinyl butyral, polyacrylamide, cellulose acetate butyrate, cellulose acetate propionate, polymethyl methacrylate, polyvinyl pyrrolidone, polystyrene, ethyl cellulose, polyvinyl chloride, chlorinated rubber, polyisobutylene, butadiene-styrene copolymers, vinyl chloridevinyl acetate copolymers, vinyl acetate-vinyl chloride-maleic acid-terpolymers, polyvinyl alcohol, polyvinyl acetate, benzyl cellulose, polyvinyl acetate, acetylcellulose, cellulose propionate and cellulose acetate phthalate, etc. Of these polymers, polyvinyl butyral, polyvinyl acetate, ethyl cellulose, polymethyl methacrylate and cellulose acetate butyrate are more preferred. The most preferred material is polyvinyl butyral. If desired, two or more of these materials can be used as a mixture. The ratio by weight of the binder to the organic silver salt of component (a) generally ranges from about 10:1 to about 1:10 and preferably about 4:1 to about 1:4.

The layers containing each component described herein and other layers in the present invention can be applied to many kinds of supports. Examples of supports which can be used in the present invention are synthetic resin films such as cellulose nitrate films, cellulose ester films, polyvinyl acetal films, polyethylene films, polyethylene terephthalate films or polycarbonate films, etc., glass plates, paper and metal plates such as an aluminium plate, etc. Partially acetylated materials can also be used. Further, baryta paper, synthetic resin coated paper and water-resistant paper can be used as well. It is further preferred from the viewpoint of handling that the support be flexible. Art paper, coated paper and clay processed paper are preferred as paper supports, and, in fact, paper supports in general are preferred. Paper which has been sized with a polysaccharide, etc., is also preferred.

In addition, patterns can optionally be printed on either side of the support, i.e., the light-sensitive layer-coated side or the back layer-coated side. In the case of transparent light-sensitive layers or back layers, the patterns may be printed directly on the support.

The organic silver salt and the silver halide are each used in the amount such that the sum total of silver amount of both coated on the support is about 0.2 g to about 3 g, preferably about 0.3 g to about 2 g, per $m^2$ of the support. If the amount coated is below about 0.2 g, the image density is low. If the amount coated is above about 3 g, the cost is increased while no additional advantages in photographic properties are achieved.

The heat developable light-sensitive materials used in the present invention can have an antistatic layer or an electrically conductive layer. These layers can contain soluble salts such as halides or nitrates, ionic polymers as described in U.S. Pat. Nos. 2,861,056 and 3,206,312, and insoluble inorganic salts as described in U.S. Pat. No. 3,428,451. Further, the heat developable light-sensitive materials can have an evaporation-deposited metal layer. If desired, the heat developable light-sensitive materials of the present invention can contain an antihalation material or an antihalation dye. Preferred examples of such dyes are those dyes which are decolored upon heat development. For example, the dyes described in U.S. Pat. Nos. 3,768,019, 3,745,009 and 3,615,432 are preferred. Further, filter dyes or light absorbing materials as described in U.S. Pat. Nos. 3,253,921, 2,527,583 and 2,956,879 can be incorporated into the heat developable light-sensitive materials of this invention.

If desired, the heat developable light-sensitive materials of the present invention can contain a matting agent such as starch, titanium dioxide, zinc oxide, silica, polymer beads such as those described in U.S. Pat. Nos. 2,922,101 and 2,761,245, kaolin or clay, etc. Furthermore, they can contain an optical whitening agent such as the stilbenes, triazines, oxazoles or coumarins as described in, for example, German Pat. Nos. 972,067 and 1,150,274, French Pat. No. 1,530,244 and U.S. Pat. Nos. 2,933,390 and 3,406,070. These optical whitening agents can be used as an aqueous solution or as a dispersion.

The heat developable light-sensitive materials of the present invention can additionally contain a plasticizer and a lubricant. For example, glycerin, diols, polyhydric alcohols as described in U.S. Pat. No. 2,960,404, aliphatic acids or esters as described in U.S. Pat. Nos. 2,588,765 and 3,121,060 and silicone resins described in, for example, British Pat. No. 955,061 can be used as plasticizers and lubricants. Furthermore, the light-sensitive materials can contain a surface active agent, for example, saponin and alkylaryl sulfonates described in, for example, U.S. Pat. No. 2,600,831, ampholytic compounds described in, for example, U.S. Pat. No. 3,133,816 and addition products of glycidol and alkyl phenols described in, for example, British Pat. No. 1,022,878. Hardenable layers of the heat developable light-sensitive layers used in the present invention can be hardened by organic or inorganic hardening agents. These hardening agents can be used individually or as a combination of two or more thereof. Preferred hardening agents are aldehydes, blocked aldehydes, ketones, carboxylic acids, carbonic acid derivatives, sulfonic acid esters, sulfonyl halides, vinyl sulfonyl esters, active halogen compounds, epoxy compounds, aziridines, active olefins, isocyanates, carbodiimides and polymeric hardening agents such as dialdehyde starch, etc. Further, many additives can be used for increasing the density of the resulting images. For example, non-aqueous polar organic solvents such as compounds having a $$-\underset{\underset{O}{\|}}{C}-,\quad -\underset{\underset{O}{\|}}{S}-$$

or $-SO_2-$ group as described in U.S. Pat. No. 3,667,959, for example, tetrahydrothiophene-1,1-dioxide, 4-hydroxybutanoic acid lactone and methylsulfinyl methane are effective. Zinc, cadmium and copper acetates as described in U.S. Pat. No. 3,708,304 are also effective. Furthermore, compounds containing water of crystallization as described in U.S. Pat. No. 3,635,719, acid salts of amines and compounds which become alkaline on heating such as metal oxides or hydroxides are effective as the materials for accelerating development. It is possible to use polyalkylene glycols together with mercaptotetrazole in order to improve the sensitivity, contrast and image density as described in U.S. Pat. No. 3,666,477.

The heat developable light-sensitive materials of the present invention can have a subbing layer between the support and the heat developable light-sensitive layer. Examples of binders which can be used for such a subbing layer include various polymers as described hereinbefore. For example, polyvinyl butyral, polyacrylamide, cellulose acetate butyrate, cellulose acetate propionate, polymethyl methacrylate, polystyrene, polyvinyl pyrrolidone, ethyl cellulose, polyvinyl chloride, chlorinated rubber, polyisobutylene, butadiene-styrene copolymers, vinyl chloride-vinyl acetate copolymers, vinyl acetate-vinyl chloride-maleic acid terpolymers, polyvinyl alcohol, polyvinyl acetate, cellulose acetate, cellulose propionate, cellulose acetate phthalate, gelatin, gelatin derivatives and polysaccharides, etc., can be used. It is possible to improve the photographic properties such as light-discoloration or heat fog, etc., by incorporating aliphatic acids or metal salts thereof in the subbing polymer layer. Further, it is possible to prevent permeation of solvents by incorporating pigments such as clay into the subbing layer. In addition, a matting agent such as silica, kaolin, titanium dioxide or zinc oxide can be added to the subbing layers. Further, a nonelectrolytic deposition layer composed of a conductive metal as described in U.S. Pat. No. 3,748,137 can be present. It is also possible to improve the moisture resistance or to prevent curling in case of a paper support by providing a hydrophobic polymer layer on the back of the support.

Further, it is possible to provide, if desired, a top-coating polymer layer on the light-sensitive layer in order to enhance the transparency of the heat developable light-sensitive layer, to increase the image density and to improve the shelf life, as described in West German Patent Application (OLS) 2,323,452. A preferred thickness for the top coating polymer layer ranges from about 1 micron to about 20 microns. Examples of polymers suitable for the top-coat polymer layer include polyvinyl chloride, polyvinyl acetate, vinyl acetate-vinyl chloride copolymers, polystyrene, polymethyl methacrylate, methyl cellulose, ethyl cellulose, cellulose acetate butyrate, cellulose acetate, polyvinylidene chloride, cellulose propionate, cellulose acetate phthalate, polycarbonate, cellulose acetate propionate and polyvinyl pyrrolidone, etc. A top coat polymer layer containing a material such as kaolin, silica or a polysaccharide such as starch therein, as described in Belgian Pat. No. 798,367 and Japanese Patent Application (OPI) 46316/1975 provides the heat developable light-sensitive material with the ability to be written upon with a ball-point pen or a pencil. Further, the top coat polymer layer can contain a filter dye, an ultraviolet light absorbing agent or an acid stabilizing agent such as higher aliphatic acids, etc.

Various methods can be utilized in order to prevent the generation of heat fog of the heat developable light-sensitive materials of the present invention. One method comprises using mercury compounds, as described in U.S. Pat. No. 3,589,903. Further, it is possible to form direct positive images using mercury compounds as described in U.S. Pat. No. 3,589,901. Furthermore, the mercury compounds can be used together with color forming couplers in order to form stabilized color images as described in U.S. Pat. No. 3,764,328. A second method for preventing the generation of heat fog is described in West German Patents (OLS) 2,326,865, 2,402,161, 2,364,630, wherein N-halo compounds such as N-halosuccinimides or N-haloacetamides are used.

Further, mercury compounds or some types of N-halogenides may be added to the sensitive materials in order to stabilize to light before heating, and the heat developable light-sensitive materials may be rendered light-sensitive by a preheat before the image-wise exposure as disclosed in Japanese Patent Laid-Open 80030/73, 51626/73, 89720/73 and 10039/74, and German Patent (OLS) No. 2,315,233. Further, the application of heat before image-wise exposure will make it possible to control the sensitivity and the contrast of images as disclosed in, for example, Japanese Patent Laid-Open No. 43630/73.

Still another method for the prevention thermal fog comprises the addition of acid-stabilizers, for example, higher fatty acids such as lauric acid, myristic acid, palmitic acid, stearic acid, behenic acid, etc.; tetrahalogenophthalic acid or the anhydrides thereof; aryl sulfonic acids such as benzene sulfonic acid, p-toluene sulfonic acid, etc.; aryl sulfinic acids such as benzene sulfinic acid, p-toluene sulfinic acid, etc., or aryl sulfinates; lithium salts of higher fatty acids such as lithium myristate, lithium stearate, lithium behenate, lithium palmitate, lithium laurate, etc.; and the like, as disclosed in, for example, U.S. Patent 3,645,739; Japanese Patent Applications (OPI) 125016/74, (OPI) 57619/75 U.S.P. 3,885,968; and Japanese Patent Laid-Open 89720/73. Other effective acid-stabilizers include alkyl substituted benzoic acids such as salicylic acid, p-hydroxybenzoic acid, tetrabromobenzoic acid, tetrachlorobenzoic acid, p-acetoamidebenzoic acid, p-t-butylbenzoic acid, etc.; phthalic acid, isophthalic acid, trimellitic acid, pyromemmitic acid, diphenic acid, 5',5'-methylenebissalicylic acid and the like. These acid-stabilizers, in some instances, not only prevent thermal fog in the finished light-sensitive materials but also prevent them from discoloring when they are exposed to white light, and increase the density, and improve their freshness-retention capability (so that the light-sensitivie materials retain this "as manufactured" characteristics for long storage periods).

Compounds which can effectively protect light-sensitive materials against thermal fog include benzotriazole and the derivatives thereof, thiouracils such as 2-thiouraciles represented by the following formula:

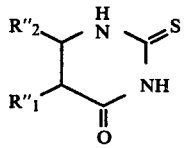

wherein $R_1''$ represents a hydrogen atom, a hydroxy group, an alkoxy group, a halogen atom, a lower unsubstituted or substituted alkyl group, a benzyl group, an allyl group, an amino group, a nitro group or a nitroso group, and $R_2''$ represents a hydrogen atom, a hydroxy group, a halogen atom, an amino group, an acetoamide group, an unsubstituted or substituted alkyl group having 1 to 22 carbon atoms, a phenyl group or a substituted aryl group, mercapto compounds such as 1-phenyl-5-mercaptotetrazole, etc., azole thioethers or blocked azolethiones, disulfides of peroxides or persulfates such as

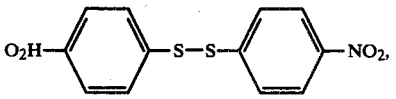

as disclosed in U.S. Pat. No. 4,028,129.

Further, the addition of chromium salts, rhodium salts, copper salts, nickel salts, cobalt salts; rhodium-, iron-, cobalt-, or palladium-complexes; and the like to the light-sensitive composition during or before the formation of the silver halides is effective for the prevention of thermal fog and the improvement of photographic properties such as sensitivity, etc.

To prevent the processed heat developable light-sensitive material employed in the practice of the present invention from discoloring upon exposure to light (the phenomena that unexposed areas of the processed material gradually change color when exposed to room light), precursors of stabilizing agents such as azolethioether and blocked azolethiones as disclosed in, for example, Japanese Patent Laid-Open 318/72, tetrazolythio compounds as disclosed in U.S. Pat. No. 3,700,457; and light-sensitive halogen-containing organic oxidizing agents can be added to the heat developable light-sensitive materials.

In addition, light-absorbing dyes can be added particularly to light-sensitive polymer materials in order to increase their resolving power, as disclosed in Japanese Patent Publication 33692/73. Moreover, leuco dyes as disclosed in, for example, U.S. Pat. No. 4,021,250, can be employed to improve the freshness-retention capability. Further, blue dyes such as Victoria Blue make it possible to improve the whiteness of unexposed areas, as they can reduce the residual color of dyes by a blueing technique.

Processed light-sensitive materials can even be further stabilized against light and heat in some cases. As examples of methods effective for such a stabilization, mention can be made of stabilizing by the use of a mercapto compound-containing solution as disclosed in U.S. Pat. No. 3,617,289; stabilizing by putting a stabilizing agent-containing laminate layer on the final coat of the finished light-sensitive material as disclosed in U.S. Pat. No. 3,997,346, and stabilizing by exposing the finished light-sensitive materials to an aldehyde compound in the gaseous state.

The heat developable light-sensitive materials of the present invention are cut to appropriate sizes and are developed by heating after image-wise exposure.

The light-sensitive materials of the invention can be preheated before exposure to light as described above (to about 80° C. to 140° C.). Light sources suitable for image-exposure are tungsten lamps, fluorescent lamps used for exposing diazotype light-sensitive materials, mercury lamps, xenon lamps, cathode ray tube (CRT) light sources and laser light sources, etc. As originals, not only line images such as drawings but also photographic images having gradation can be used. Further, it is possible to directly photograph people and landscapes using a camera. The light-sensitive materials can be printed by direct contact of the light-sensitive material with the original, or can be printed using a reflection printing method or using an enlarged printing method. Although exposure depends upon the sensitivity of the light-sensitive materials, an exposure of about 10 lux.second is required for high speed sensitive materials and an exposure of about $10^4$ lux.second is required for low speed sensitive materials. The thus image-exposed light-sensitive materials can be developed simply by heating (e.g., to about 80° C. to about 180° C., preferably about 100° C. to about 150° C.). The heating time can be suitably, for example, about 1 second to 60 seconds. The heating time, of course, is related to the heating temperature employed. In general, a suitable heating time is about 5 seconds to about 40 seconds at 120° C., about 2 seconds to about 20 seconds at 130° C. and about 1 second to about 10 seconds at 140° C.

Various means can be used for heating. For example, the light-sensitive material can be contacted with a simple heated plate or with a heat drum or, if desired, it can be passed through a heated space. Further, the heating can be carried out by high frequency heating or by laser beams. In order to prevent a bad odor from being emitted on heating, the processing devices can be equipped with a deodorizer. It is also possible to incorporate certain perfumes so as to mask any bad odor of the light-sensitive materials which might be formed.

The preparation of heat developable light-sensitive materials of the invention will be illustrated by reference to the following examples and is briefly explained as follows.

An organic silver salt-forming agent is reacted with a silver ion-providing agent (e.g., silver nitrate) using one of the various methods described above to form an organic silver salt. The preparation conditions are at atmospheric pressure and a temperature of about −15° C. to 80° C., preferably about 20° to 60° C. After washing the prepared organic silver salt with water or an alcohol, the salt is dispersed in a binder for an emulsion using a colloid mill, a mixer or a ball mill at normal temperature (e.g., about 15° to 25° C.). To the polymer dispersion of the silver salt, a silver halide forming agent is added to convert a part of the organic silver salt to silver halide. In this case, the reaction temperature ranges from about normal temperature to about 80° C., and the reaction time is up to about 48 hours, preferably about 1 minute up to within 48 hours. Further, a previously prepared silver halide as described above can be added, or silver halide can be simultaneously prepared along with the organic silver salt. Then, any additives such as spectral sensitizing dyes, reducing agents or toning agents are added, preferably as solutions thereof. These solutions are usually added at suitable intervals (e.g., about 5 to 20 minutes) to the system with stirring at about normal temperature to 50° C. When all additives have been added, the coating composition is then coated on a suitable support using a coating apparatus.

The resulting coating solution is coated without being dried on a support.

The heat developable light-sensitive layers, the top-coat polymer layer, a subbing layer, a back layer and other layers used in the present invention can be coated on a support using various coating methods. Examples of such methods are a dip-coating method, an air-knife coating method, a curtain coating method and a hopper coating method. If desired, two or more layers can be coated at the same time using the methods described in U.S. Pat. No. 2,761,791 and British Pat. No. 837,095.

The heat developable light-sensitive materials as in the present invention generally have the characteristic that the photographic properties thereof are easily deteriorated by moisture. Therefore, when the prepared light-sensitive materials are packed and sent into the trade as commodities, a drying agent, as described in West German Patent Application (OLS) 2,422,040, is generally packed with the materials.

In accordance with the present invention, heat developable light-sensitive materials which provide images of black tone and have excellent freshness-retention capability are obtained.

The present invention will now be illustrated in greater detail by several non-limiting examples.

EXAMPLE 1

1.9 g of Sodium hydroxide dissolved in 100 ml of water and 12 g of lauric acid in 100 ml of toluene were mixed to emulsify (at 25° C.) the same. An aqueous solution of 8.5 g of silver nitrate dissolved in 50 ml of water was then added to the emulsion. Upon five minutes' storage, the emulsion separated into a silver laurate-containing toluene phase and an aqueous phase. After removal of aqueous phase, the toluene phase was dispersed into 200 ml of ethanol, and then silver laurate collected by centrifugation. 12 g of spindle-like silver laurate crystals about 3μ in longer diameter was obtained. (Instead of toluene which was used in the above procedure, benzene, pentene, cyclohexane, butyl acetate, isoamyl acetate, butyl alcohol, tricresyl phosphate, dibutylphthalate, and the like can be used, and silver laurate obtained similarly to the above.)

A polymer dispersion of the silver laminate was prepared by dispersing 6 g of the resulting silver laurate (about 1/50 mole) and 12 g of polyvinyl butyral in 70 g of ethyl alcohol by means of a mixer. As the dispersing medium, methanol, propanol or isopropanol can be used instead of ethyl alcohol, and the same results obtained. The polymer dispersion of silver laurate was maintained at 50° C. 0.15 of N-bromosuccinimide (silver halide-forming component) was then added to the above polymer dispersion with stirring, and then the resultant dispersion allowed to stand for 90 minutes at 50° C. with stirring maintained. (Instead of N-bromosuccinimide, N-bromoacetoamide, N-bromophthalazinone and other N-halogeno compounds could be used to give similar results.)

After chill-setting the resultant dispersion at 30° C., a heat developable light-sensitive coating solution was prepared by adding the components set forth below (in the recited order) at 5 minute intervals to the above resultant dispersion, with stirring at 30° C.

(a) Sensitizing dye (merocyanine dye represented by the following formula)

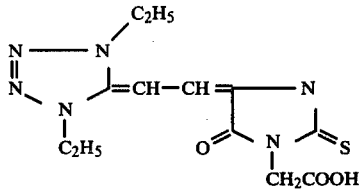

(0.025% methyl Cellosolve solution); 10 ml [Instead of this dye, other merocyanine dyes, cyanine dyes or acidic dyes could be used in a similar manner]

(b) Phthalazinone (color toning agent)
(3 wt% methanol solution); 100 ml (c) Reducing agent
2,2-bis-(3,5-dimethyl-4-hydroxyhphenyl)propane
(20 wt% acetone solution); 60 ml The resultant coating solution was then coated on a support (art paper) having a phthalazinone-containing back layer on the opposite surface at a coverage of 0.4 g of silver per square meter.

The phthalazinone-containing backing layer was formed on the support as follows. A polymer solution which was prepared by dissolving 1 g of phthalazinone in 100 g of a 3 wt% acetone solution of cellulose acetate was coated on art paper at a coverage of 30 g per square meter. For purposes of comparison, an identical light-sensitive solution as above was similarly coated on an art paper support having a backing layer prepared by coating 3 wt% aetone solution of cellulose acetate onto the art paper at a coverage of 30 g per square meter and on a support having no backing layer. The resultant light-sensitive materials were identified (1), (2) and (3), respectively.

A finally coating solution prepared by dispersing 3 g of silica in 100 ml of a 10 wt% acetone solution of cellulose acetate was further coated onto the light-sensitive side of each of sensitive materials (1), (2) and (3) so that the thickness of the final coating thereof in the dry condition was about 1.5 micron.

The resultant heat developable light-sensitive materials (1), (2) and (3) were image-wise exposed to a tungsten lamp (exposure amount $10^3$ lux.second) through an original having gradation and through a step-wedge, and then developed by heating at 135° C. for 3 seconds. The maximum density, the minimum density (thermal fog) and the sensitivity (indicated by the logarithmic value of the exposure amount necessary to obtain a density of 0.6) were examined for each sample obtained. In addition, when the samples were printed (printing was conducted using a negative film having a pattern, not using a step wedge), they reproduced black tone images having good gradation.

With the intention of examining the freshness-retention capability, heat developable light-sensitive materials (1), (2) and (3) were each was cut into 10 sheets. The ten sheets were superposed upon one another so that the light-sensitive layer of one came into contact with the backing layer of another sheet and the stack tightly sealed into a vinyl polymer bag. These bags were allowed to stand for one day at 50° C. These light-sensitive materials subjected to forced deterioration at high temperature were designated as (1)', (2)' and (3)', respectively. The fifth sheet of each of these light-sensitive materials (a sheet in the middle) (1)', (2)' and (3)' was exposed, heat developed and examined as above.

The results obtained are shown in the following table.

| | Maximum density | Minimum density | Sensitivity (log value) |
|---|---|---|---|
| Sensitive material (1) | 1.35 | 0.08 | 2.50 |
| Sensitive material (2) | 1.36 | 0.08 | 2.50 |
| Sensitive material (3) | 1.34 | 0.07 | 2.45 |
| Sensitive material (1)' (forced deterioration) | 1.30 | 0.07 | 2.65 |
| Sensitive material (2)' (forced deterioration) | 0.30 | ~0 | the value necessary to obtain a density of 0.3 ; 3.60 |
| Sensitive material (3)' (forced deterioration) | ~0 | ~0 | — |

As is apparent from the Table, in the case of using the support where the back side had no phthalazinone-containing layer, light-sensitive material (3) or (3)' would not yield images when subjected to forced deterioration. On the other hand, in the case of using a support having a phthalazinone-containing backing layer, a remarkable improvement in the freshness-retention capability was achieved.

For the purpose of further comparison, 10 sheets of each of light-sensitive materials (1), (2) and (3) were sealed in a container so that the sheets were not in contact with each other, and allowed to stand for one day at 50° C. These "forced-deteriorated" sensitive materials were termed (1)", (2)" and (3)", respectively. These samples were exposed as above by using the same sensitometer. The results are whown in the following table.

| Forced deteriorated light-sensitive material | Maximum density | Minimum density | Sensitivity (log E value) |
|---|---|---|---|
| (1)" | 1.31 | 0.09 | 2.63 |
| (2)" | 1.21 | 0.09 | 2.75 |
| (3)" | 1.20 | 0.10 | 2.90 |

It will be seen that the light-sensitive material of the present invention is improved in its freshness-retention capability in the superposed condition.

REFERENCE 1

A heat developable light-sensitive material (Type-795 manufactured by 3 M Company) was subjected to a forced deterioration test as in Example 1. Where the light-sensitive sheets were superposed upon one another was termed Test (A), and where the light-sensitive sheets were subjected to forced deterioration without superposing them on one another was termed Test (B). Further, art paper on both sides of which a polymer solution of 1 g of phthalazinone dissolved in 100 g of a 3 wt % acetone solution of cellulose acetate was coated at a coverage of 30 g per square meter (the same as in Example 1) was put between the sheets of the light-sensitive material (Type-795), and they were subjected to the same test as in Test (A). This case was called Test (C). The test carried out where only art paper was put between two sheets of the light-sensitive material (Type-795) was termed Test (D). The forced deterioration test was carried out under the same condition as in Example 1 except that developing conditions of 120° C. for 8 seconds were used. The results are given below.

| Test | Maximum density | Minimum density | Sensitivity (log value) |
|---|---|---|---|
| (A) | 0.10 | 0.06 | — |
| (B) | 1.18 | 0.10 | 2.4 |
| (C) | 1.17 | 0.10 | 2.4 |
| (D) | 0.05 | 0.03 | — |
| Fresh material | 1.21 | 0.19 | 2.3 |

As is apparent from these results, the freshness-retention capability of the light-sensitive materials becomes poor when they are superposed upon each other. Moreover, the back surface of the support paper exerts some effect on the freshness-retention capability, as is apparent from above Tests (A)–(D).

EXAMPLE 2

A phthalazinone-containing support was prepared as follows. A 2 wt% methanol solution of phthalazinone was sprayed onto a support paper (art paper) at a coverage of 10 cc per square meter, and dried at 70° C. for 5 minutes. Then, the same light-sensitive coating solution as in Example 1 was coated on the side of the support paper opposite the phthalazinone-sprayed surface at a coverage of 0.4 g of silver per square meter. Further, a final coating solution wherein 3 g of silica was dispersed in 100 ml of a 10 wt% acetone solution of cellulose acetate was applied to provide a dry thickness of 5μ on the light-sensitive side and dried. This heat developable light-sensitive material was identified light-sensitive material (4). Light-sensitive material (4) was examined the same as in Example 1 to determine the characteristics thereof before and after the forced deterioration test.

| | Maximum density | Minimum density | Sensitivity (log value) |
|---|---|---|---|
| Sensitive material (4) | 1.35 | 0.07 | 243 |
| Forced deterioration (4) | 1.28 | 0.08 | 2.65 |

As is apparent from the above results, the sensitive material containing phthalazinone at the back side of the support paper shows improved freshness-retention capability.

EXAMPLE 3

3.4 g of behenic acid was dissolved in 100 ml of benzene at 60° C., and the solution maintained at 60° C. while 100 ml of water was added to the above solution to form an emulsion with stirring. Ammonia water was added to 80 ml of an aqueous solution containing 1.7 g of silver nitrate to prepare a silver-ammonium complex, and then water was further added to make the total volume 100 ml. The resulting silver-ammonium complex-containing solution (which was chill-set at 10° C.) was added to the above emulsion, resulting in the formation of crystals of silver behenate. The reaction product was warmed to room temperature (25° C.), and allowed to stand for 20 minutes, it then separated into an aqueous phase and a benzene phase. After removal of the aqueous phase, the benzene phase was washed with 400 ml of water by decantation. 400 ml of methanol was then added to the benzene phase, and silver behenate collected by centrifuging. 4 g of spindle-like silver behenate about 1μ in longer diameter and about 0.05μ in shorter diameter was obtained.

Toluene, xylene, pentyl acetate, isoamyl acetate and the like can be effectively used in the place of benzene for preparing silver behenate in a manner similar to the above.

2.3 g of the resulting silver behenate (about 1/200 mole) was dispersed into 20 ml of ethanol solution containing 2.5 g of polyvinyl butyral (one hour mixing with a ball-mill was required). Methanol, propanol and isopropanol can be used effectively instead of ethanol.

The compounds set out below were added to the above polymer dispersion in their order of recitation at 5 minute intervals while maintaining the temperature at 50° C.

(a) Ammonium bromide (silver halide-forming component)
(2.5 wt% methanol solution); 1 ml
(b) Mercury acetate 1 wt % methanol solution; 2 ml
(c) Sensitizing dye (merocyanine represented by the following formula)

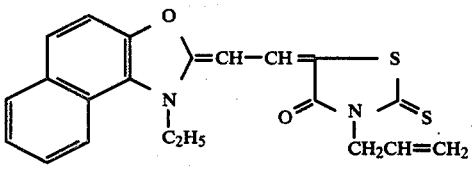

(0.025 wt% methyl cellosolve solution); 1 ml
(d) Behenic acid (3 wt% toluene solution); 10 ml
(e) 2,2'-methylenebis(6-t-butyl-4-methylphenol) (reducing agent)
(2.5 wt % acetone solution); 3 ml
(f) Phthalazinone (color toning agent)
(2.5 wt% methyl cellosolve solution); 3 ml 0.7 g of phthalazinone was dispersed in 100 g of a 2 wt% solution (solvent mixed solution of acetone and toluene; 1:1 volume ratio) of a vinyl chloride-vinyl acetate copolymer, and the resulting polymer dispersion was coated onto a clay-coated paper at a coverage of 30 g per square meter to provide a support.

The above-mentioned coating solution was applied to the surface of the support opposite to the polymer solution-coated side at a coverage of 0.5 g of silver per square meter to yield light-sensitive material (5). For purposes of comparison, a heat developable light-sensitive material (6) was prepared in the same manner except for using a support whose back side was free of the phthalazinone-containing vinyl chloride-vinyl acetate copolymer. These materials were subjected to forced deterioration testing under the same conditions as in Example 1. In the forced deterioration test on the surperposed sensitive materials, sensitive material (6) hardly yielded images, while sensitive material (5) yielded excellent images. In addition, in the case of the forced deterioration test without superposing the sensitive materials, both sensitive materials (5) and (6) provided excellent images. (Both sensitive materials (5) and (6) provided excellent images before forced deterioration was carried out.)

The exposure and developing conditions were as in Example 1 except the temperature and time of development was 120° C. for 15 seconds.

EXAMPLE 4

20 ml of a 2.5 wt% aqueous solution of hydrogen bromide was added to a solution of 8.6 g of capric acid in 100 ml of butyl acetate, which was maintained at temperature of 50° C., and stirred form an emulsion. 50 ml of an aqueous solution of silver nitrate-ammonium complex (1:1 molar) containing 8.5 g of silver nitrate (which was chill-set at 5° C.) was added to the resulting emulsion at 50° C. over a 30 second period to simultaneously react capric acid and hydrogen bromide with the silver nitrate, whereby silver caprate and silver bromide were formed at the same time. (It can easily be seen that other silver halide-forming compounds will undergo a similar reaction.)

After removal of the aqueous phase, the butyl acetate phase containing both silver caprate and silver bromide was dispersed in 120 g of a 15 wt % isopropanol solution of polybutyral to form a polymer dispersion. The compounds set forth below were added to the polymer dispersion in their recited order at 5 minutes intervals while keeping the temperature at 30° C.

(a) Mercury acetate (0.5 wt% methanol solution); 20 ml
(b) Sensitizing dye (that used in Example 3)
(0.025 wt% methyl cellosolve solution); 15 ml
(c) Lauric acid (3 wt% ethanol solution); 60 ml
(d) Phthalazinone (3 wt% methanol solution); 60 ml
(e) p-Phenylphenol (20 wt% acetone solution); 50 ml Next, 0.5 g of phthalazinone was dispersed into 100 g of a 2 wt% methyl ethyl ketone solution of ethyl cellulose, and the resulting polymer solution was coated onto a clay-coated paper at a coverage of 50 g per square meter and dried.

A heat developable light-sensitive material (7) was formed by the above light-sensitive coating solution being coated on the opposite surface of the support to the polymer solution-coated side at a coverage of 0.5 g of silver per square meter. For purposes of comparison, a heat developable light-sensitive material (8) was prepared by using an identical support except the phthalazinone-containing ethyl cellulose solution was not coated on the back side thereof. These materials were each exposed as in Example 1 and subjected to forced deterioration under the same conditions as in Example 1, wherein the sensitive materials were superposed upon each other. Sensitive material (8) would not yield images, while sensitive material (7) provided excellent images. (Before the forced deterioration treatment, both sensitive materials (7) and (8) produced excellent images.

Developing was at 120° C. for 15 seconds.

EXAMPLE 5

The procedure of Example 1 was repeated except that phthalimide was employed instead of phthalazinone in the back layer. The sensitive material with a back layer containing phthalimide provided excellent results, i.e., as good as the sensitive material having a back layer containing phthalazinone.

EXAMPLE 6

The procedure of Example 1 was repeated except that 2,3-dihydro-1,4-phthalazinedione was employed instead of phthalazinone in the back layer. In this case, results as good as when phthalazinone was in the back layer were obtained.

While the invention has been described in detail and with reference to specific embodiments thereof, it will be apparent to one skilled in the art that various changes and modifications can be made therein without departing from the spirit and scope thereof.

What is claimed is:

1. In a heat-developable light-sensitive material which has on the support thereof at least one layer containing at least (a) an organic silver salt, (b) a light-sensitive silver halide or a light-sensitive silver halide-forming component, (c) a reducing agent and (d) phthalazinone, the improvement which comprises the light-sensitive material further having on the surface of the support opposite to said layer a second layer containing at least one compound selected from the group consisting of compounds represented by the formulae:

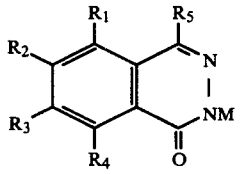

(A)

wherein $R_1$, $R_2$, $R_3$ and $R_4$ each represents a hydrogen atom, a halogen atom, an alkyl group, an alkoxy group, a nitro group, an amino group or a hydroxy group and $R_5$ represents a hydrogen atom, an alkyl group, an alkoxy group, an aryl group, a pyridyl group or a vinyl group and M is a monovalent metal ion,

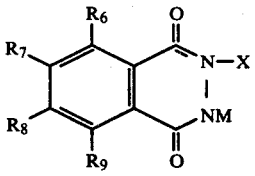

(B)

wherein $R_6$, $R_7$, $R_8$ and $R_9$ each represents a hydrogen atom, a halogen atom, a hydroxy group, an alkyl group, an aryl group, an amino group, an alkyl-substituted amino group, a nitro group, an alkoxy group, a thioalkoxy group or an acylamide group, and X represents a hydrogen atom, an aryl group, a pyridyl group, a 2-(2-pyridyl)ethyl group, a 2-(4-pyridyl)ethyl group, a benzoyl group or a methyl group and M is a monovalent metal ion, and

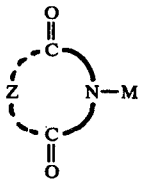

(C)

wherein Z represents an atomic group necessary to complete a heterocyclic ring and M is a monovalent metal ion.

2. The heat developable light-sensitive material of claim 1, wherein said compound is present in an amount of about 0.01 to about 10 g per square meter of the support.

3. The heat developable light-sensitive material of claim 1, wherein said compound is present in an amount of about 0.1 to about 1 g per square meter of the support.

4. The heat developable light-sensitive material of claim 2, wherein said compound is selected from the group consisting of phthalazinone,

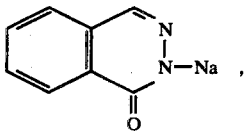

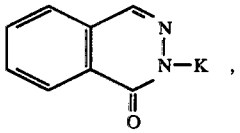

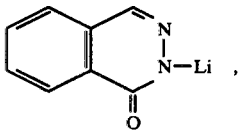

4-methylphthalazinone, 4-phenylphthalazinone, 4-(1-naphthyl)phthalazinone, 4-(2-naphthyl)phthalazinone, 4-hydroxymethylphthalazinone, 4-chlorophthalazinone, 4-(p-chlorophenyl)phthalazinone, 4-(p-pyridino)phthalazinone, 4-methoxyphthalazinone, 4-β-styrylphthalazinone, 4-dimethylaminomethylphthalazinone, 4-morpholinomethylphthalazinone, 4-(p-methoxybenzyl)phthalazinone, 4-(benzylidenehydrazino)phthalazinone, 4-(p-dimethylaminophenyl)phthalazinone, 4-benzylphthalazinone, 6-chlorophthalazinone, 5,7-dimethoxyphthalazinone, 8-methylphthalazinone, 6-bromophthalazinone, 2,3-dihydro-1,4-phthalazinedione, sodium salt of 2,3-dihydro-1,4-phthalazinedione, 5-chloro-2,3-dihydro-1,4-phthalazinedione, 5-bromo-2,3-dihydro-1,4-phthalazinedione, 2,3-dihydro-6-hydroxy-1,4-phthalazinedione, 2,3-dihydro-5-hydroxy-1,4-phthalazinedione, 5-amino-2,3-dihydro-1,4-phthalazinedione, 5-acetoamide-2,3-dihydro-1,4-phthalazinedione, 6-amino-2,3-dihydro-1,4-phthalazinedione, 2,3-dihydro-2-phenyl-1,4-phthalazinedione, 2,3-dihydro-2-(1-naphthyl)-1,4-phthalazinedione, 2,3-dihydro-2-(2-naphthyl)-1,4-phthalazinedione, 2,3-dihydro-5-nitro-1,4-phthalazinedione, 2,3-dihydro-2-[2-(2-pyridyl)ethyl]-1,4-phthalazinedione, 2,3-dihydro-2-[2-(4-pyridyl)ethyl]-1,4-phthalazinedione, 5-dimethylamino-2,3-dihydro-1,4-phthalazinedione, 2,3-dihydro-2-(2-pyridyl)-1,4-phthalazinedione, 2-benzoyl-2,3-dihydro-1,4-phthalazinedione, 2,3-dihydro-2-methyl-1,4-phthalazinedione, 2,3-dihydro-5-methyl-1,4-phthalazinedione, 2,3-dihydro-6-methyl-1,4-phthalazinedione, 2,3-dihydro-5-phenyl-1,4-phthalazinedione, 2,3-dihydro-6-phenyl-1,4-phthalazinedione, 5-bromo-2,3-dihydro-8-methoxy-1,4-phthalazinedione, 6-benzoyl-2,3-dihydro-1,4-phthalazinedione, 5,6,7,8-tetraethyl-2,3-dihydro-1,4-phthalazinedione, succinimide, phthalimide, potassium salt of phthalimide, 2,4-thiazolizinedione, 4-methoxyphthalimide, 4-ethoxyphthalimide, 4-tert-butylphthalimide, 4-hydroxyphthalimide, 4-styrylphthalimide, 3-methylphthalimide, and 4-benzoyloxyphthalimide.

5. In a heat developable light-sensitive material having a paper support which has on the surface thereof at least one layer containing at least (a) an organic silver salt, (b) a light-sensitive silver halide or a light-sensitive silver halide-forming component, (c) a reducing agent and (d) phthalazinone, the improvement which comprises the light-sensitive material further having in said support at least one compound selected from the group consisting of compounds represented by the formulae:

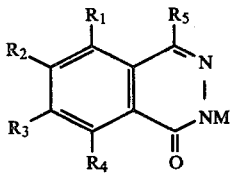

(A)

wherein $R_1$, $R_2$, $R_3$ and $R_4$ each represents a hydrogen atom, a halogen atom, an alkyl group, an alkoxy group, a nitro group, an amino group or a hydroxy group and $R_5$ represents a hydrogen atom, an alkyl group, an alkoxy group, an aryl group, a pyridyl group or a vinyl group and M is a monovalent metal ion,

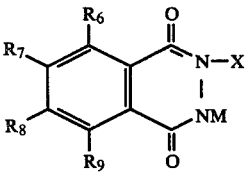

(B)

wherein $R_6$, $R_7$, $R_8$ and $R_9$ each represents a hydrogen atom, a halogen atom, a hydroxy group, an alkyl group, an aryl group, an amino group, an alkyl-substituted amino group, a nitro group, an alkoxy group, a thioalkoxy group or an acylamide group, and X represents a hydrogen atom, an aryl group, a pyridyl group, a 2-(2-pyridyl)ethyl group, a 2-(4-pyridyl)ethyl group, a benzoyl group or a methyl group and M is a monovalent metal ion, and

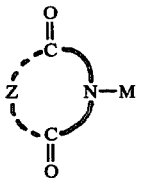

(C)

wherein Z represents an atomic group necessary to complete a heterocyclic ring and M is a monovalent metal ion.

6. The heat developable light-sensitive material of claim 5, wherein said compound is present in an amount of about 0.01 to about 10 g per square meter of the support.

7. The heat developable light-sensitive material of claim 5, wherein said compound is present in an amount of about 0.1 to about 1 g per square meter of the support.

8. The heat developable light-sensitive material of claim 6, wherein said compound is selected from the group consisting of phthalazinone,

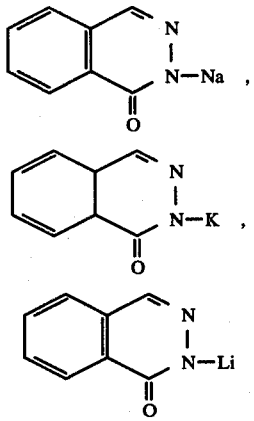

4-methylphthalazinone, 4-phenylphthalazinone, 4-(1-naphthyl)phthalazinone, 4-(2-naphthyl)phthalazinone, 4-hydroxymethylphthalazinone, 4-chlorophthalazinone, 4-(p-chlorophenyl)phthalazinone, 4-(p-pyridino)phthalazinone, 4-methoxyphthalazinone, 4-β-styrylphthalazinone, 4-dimethylaminomethylphthalazinone, 4-morpholinomethylphthalazinone, 4-(p-methoxybenzyl)phthalazinone, 4-(benzylidenehydrazino)phthalazinone, 4-(p-dimethylaminophenyl)phthalazinone, 4-benzylphthalazinone, 6-chlorophthalazinone, 5,7-dimethoxyphthalazinone, 8-methylphthalazinone, 6-bromophthalazinone, 2,3-dihydro-1,4-phthalazinedione, sodium salt of 2,3-dihydro-1,4-phthalazinedione, 5-chloro-2,3-dihydro-1,4-phthalazinedione, 5-bromo-2,3-dihydro-1,4-phthalazinedione, 2,3-dihydro-6-hydroxy-1,4-phthalazinedione, 2,3-dihydro-5-hydroxy-1,4-phthalazinedione, 5-amino-2,3-dihydro-1,4-phthalazinedione, 5-acetoamide-2,3-dihydro-1,4-phthalazinedione, 6-amino-2,3-dihydro-1,4-phthalazinedione, 2,3-dihydro-2-phenyl-1,4-phthalazinedione, 2,3-dihydro-2-(1-naphthyl)-1,4-phthalazinedione, 2,3-dihydro-2-(2-naphthyl)-1,4-phthalazinedione, 2,3-dihydro-5-nitro-1,4-phthalazinedione, 2,3-dihydro-2-[2-(2-pyridyl)ethyl]-1,4-phthalazinedione, 2,3-dihydro-2-[2-(4-pyridyl)ethyl]-1,4-phthalazinedione, 5-dimethylamino-2,3-dihydro-1,4-phthalazinedione, 2,3-dihydro-2-(2-pyridyl)-1,4-phthalazinedione, 2-benzoyl-2,3-dihydro-1,4-phthalazinedione, 2,3-dihydro-2-methyl-1,4-phthalazinedione, 2,3-dihydro-5-methyl-1,4-phthalazinedione, 2,3-dihydro-6-methyl-1,4-phthalazinedione, 2,3-dihydro-5-phenyl-1,4-phthalazinedione, 2,3-dihydro-6-phenyl-1,4-phthalazinedione, 5-bromo-2,3-dihydro-8-methoxy-1,4-phthalazinedione, 6-benzoyl-2,3-dihydro-1,4-phthalazinedione, 5,6,7,8-tetraethyl-2,3-dihydro-1,4-phthalazinedione, succinimide, phthalimide, potassium salt of phthalimide, 2,4-thiazolizinedione, 4-methoxyphthalimide, 4-ethoxyphthalimide, 4-tert-butylphthalimide, 4-hydroxyphthalimide, 4-styrylphthalimide, 3-methylphthalimide, and 4-benzoyloxyphthalimide.

9. The heat developable light-sensitive material of claim 1, wherein M is selected from the group consisting of sodium, lithium, rubidium, cesium or potassium.

10. The heat developable light-sensitive material of claim 5, wherein M is selected from the group consisting of sodium, lithium, rubidium, cesium or potassium.

* * * * *